US008087464B2

(12) United States Patent
Rodrigues et al.

(10) Patent No.: US 8,087,464 B2
(45) Date of Patent: Jan. 3, 2012

(54) SYSTEM FOR INSTALLATION AND REPLACEMENT OF A SUBSEA MODULE AND METHOD APPLIED THEREBY

(75) Inventors: Roberto Rodrigues, Rio de Janeiro (BR); Luiz Eduardo Peclat Bernardo, Rio de Janeiro (BR); Robson Soares Junior, Macac (BR); Giovani Colodette, Vitoria (BR); Romulo Cobe Vasconcellos, Vila Velha (BR); Sergio Luis Uliana, Macae (BR); Orman Salvador Toscano, Vila Velha (BR)

(73) Assignee: Petroleo Brasileiro S.A.-Petrobras, Rio De Janeiro (BR)

( * ) Notice: Subject to any disclaimer, the term of this patent is extended or adjusted under 35 U.S.C. 154(b) by 509 days.

(21) Appl. No.: 12/035,059

(22) Filed: Feb. 21, 2008

(65) Prior Publication Data

US 2008/0314598 A1 Dec. 25, 2008

(30) Foreign Application Priority Data

Jun. 22, 2007 (BR) ..... 0702808

(51) Int. Cl.
*E21B 23/00* (2006.01)

(52) U.S. Cl. ..... 166/339; 166/343; 166/352; 166/85.1; 414/137.1; 405/195.1

(58) Field of Classification Search ..... 166/343, 166/339, 341, 351, 352, 381, 385, 85.1; 114/258–260, 264; 414/137.1, 137.7–137.9; 405/195.1

See application file for complete search history.

(56) References Cited

U.S. PATENT DOCUMENTS

| | | | | | |
|---|---|---|---|---|---|
| 3,777,688 | A * | 12/1973 | Melhose | 114/293 |
| 4,075,862 | A * | 2/1978 | Ames | 405/169 |
| 4,266,886 | A * | 5/1981 | Milton | 405/169 |
| 4,744,698 | A * | 5/1988 | Dallimer et al. | 405/226 |
| 4,828,430 | A * | 5/1989 | van der Heyden | 405/209 |
| 4,900,433 | A | 2/1990 | Dean et al. | |
| 5,069,580 | A * | 12/1991 | Herwig et al. | 405/191 |
| 5,190,107 | A * | 3/1993 | Langner et al. | 166/355 |
| 5,215,410 | A * | 6/1993 | Karal | 405/205 |
| 5,255,744 | A * | 10/1993 | Silva | 166/347 |
| 5,341,884 | A * | 8/1994 | Silva | 166/347 |
| 6,354,765 | B2 * | 3/2002 | Jones | 405/203 |
| 6,457,908 | B1 * | 10/2002 | Bergeron | 405/224 |
| 6,511,261 | B2 * | 1/2003 | de Waard et al. | 405/204 |
| 6,588,985 | B1 * | 7/2003 | Bernard | 405/191 |
| 6,685,396 | B1 * | 2/2004 | Bergeron | 405/224 |
| 6,752,100 | B2 * | 6/2004 | Guinn et al. | 114/258 |
| 6,935,262 | B2 * | 8/2005 | Roodenburg et al. | 114/258 |
| 7,011,473 | B2 * | 3/2006 | Tangen et al. | 405/209 |
| 7,314,084 | B2 * | 1/2008 | Rodrigues et al. | 166/344 |
| 7,422,066 | B2 * | 9/2008 | Rodrigues et al. | 166/341 |
| 7,516,795 | B2 * | 4/2009 | Lopes Euphemio et al. | 166/357 |
| 7,600,569 | B2 * | 10/2009 | Routeau et al. | 166/344 |
| 7,770,655 | B2 * | 8/2010 | Wilde et al. | 166/381 |

* cited by examiner

*Primary Examiner* — Thomas Beach
*Assistant Examiner* — Matthew Buck
(74) *Attorney, Agent, or Firm* — Sughrue Mion, PLLC

(57) ABSTRACT

A system for installation of a subsea module of great length by means of a vessel, using a cable for its installation and/or retrieval, and methods applied therein. The system allows transporting the subsea module on the vessel to a location in the sea and descending the subsea module into the sea at a vertical position for installation on the seabed.

7 Claims, 30 Drawing Sheets

SYSTEM FOR INSTALLATION AND REPLACEMENT OF A SUBSEA MODULE AND METHOD APPLIED THEREBY

FIELD OF INVENTION

This invention relates to systems for installation and replacement of subsea modules of great length (dozens of meters) via a vessel and a cable. The system makes it possible to manipulate subsea modules of great length, either on land or at sea, without the need of using a rig and drill pipes for installation and/or replacement of such modules on the seabed.

BACKGROUND OF THE INVENTION

Prospection and production of oil fields in deep water is accompanied by complex underwater operations. Oil production, in general, requires installation and retrieval or maintenance of equipment that is settled on the seabed. In these operations, installation of the equipment is carried out by vessels or floating structures equipped with a rig for handling drill pipes. These are referred as drilling rigs and completion rigs. They are very stable when encountering heave waves but have high daily operation costs.

In deep waters, underwater operations require the use of these vessels for a longer period of time. Thus, development of systems and methods that minimize the use of these vessels is of fundamental relevance to oil production from oil fields in deep water.

For example, U.S. Pat. No. 6,752,100 teaches devices and methods for installation of underwater equipment via vessels without drill pipes. However, these devices are limited to equipment provided at a compact scale and size, such as, for example, WCT—Wet Christmas Trees and production bases.

An example of subsea equipment hereinafter referred to as a subsea module of great length may be found in patent application PI 0400926-6, which issued as U.S. Pat. No. 7,314,084, and U.S. Pat. No. 4,900,433. A subsea module is basically a thin tube of long length, i.e., a dozen meters, that usually has to be retrieved for maintenance of a motor/pump assembly coupled to it. Due to its length, retrieving the module to the surface, fixing the assembly and replacing it are complex operations that take a long time (e.g., many days) and usually require the use of an offshore rig, with a high daily cost.

Therefore, ways to minimize or eliminate the complexity during installation and replacement of equipment of great length, such as subsea modules, via vessel and cable operations, without the need of using rig and drill pipes, are still being sought.

SUMMARY OF THE INVENTION

This invention refers to a system for installation and replacement, via a vessel and a cable, of subsea modules of great length (i.e., a dozen meters), and a method applied thereby. One objective of this invention is to minimize, or even eliminate, the need of using rigs and drill pipes for underwater operations for installation and replacement of subsea modules of great length.

Another objective is the possibility of assembling/disassembling the subsea module for replacement of the motor/pump unit being carried out totally or partially on land, or at least next to the location of the installation, in the latter case via a vessel (e.g., a FPSO—Floating Production Storage Offloading Unit) equipped to provide assembly/disassembly.

The use of this system additionally makes it possible to minimize the cost of operations of installation and replacement of subsea modules in general, reducing the number workers in hostile locations, and reducing lag time of operation.

The immediate objectives mentioned above are reached by various exemplary embodiments that are described below.

BRIEF DESCRIPTION OF THE DRAWINGS

The characteristics of a system for installation and replacement of subsea modules, and the method applied thereby will be best understood in association with the drawings, in which.

DETAILED DESCRIPTION OF THE EXEMPLARY EMBODIMENTS

Figure 1:
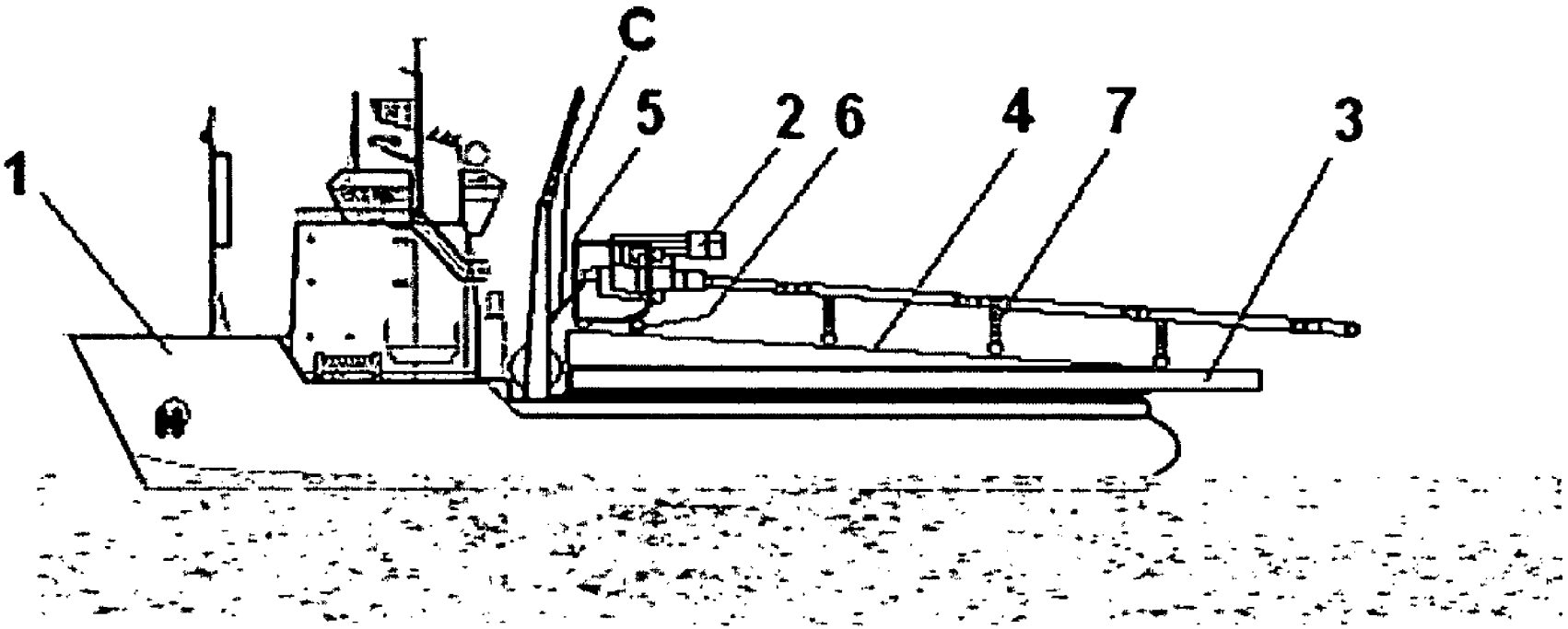
FIG. 1 illustrates an exemplary embodiment of the system in which a subsea module is on an inclined base (i.e., an almost horizontal position) on a service deck of an installation vessel.

A detailed description of the system for installation and replacement of subsea modules, and the methods applied thereby, will be made in accordance with the exemplary embodiments, which are illustrated in the drawings wherein like reference numerals refer to like elements throughout.

Exemplary embodiments of the present invention refer to systems and methods for installation, on the seabed, of a subsea module of great length via a simple and low cost vessel, with the use of a cable for installation and/or retrieval.

These exemplary embodiments make it possible to assemble and/or repair subsea modules on land, or at sea at locations close to the installation location.

An example of a subsea module is a pumping module lodged in a lined borehole drilled in the seabed, like that of U.S. Pat. No. 7,314,084, that is used in oil production from wells in the seabed. However, the invention can be applied to other types of subsea modules, for example, for integrated separation and pumping modules.

Figure 2:
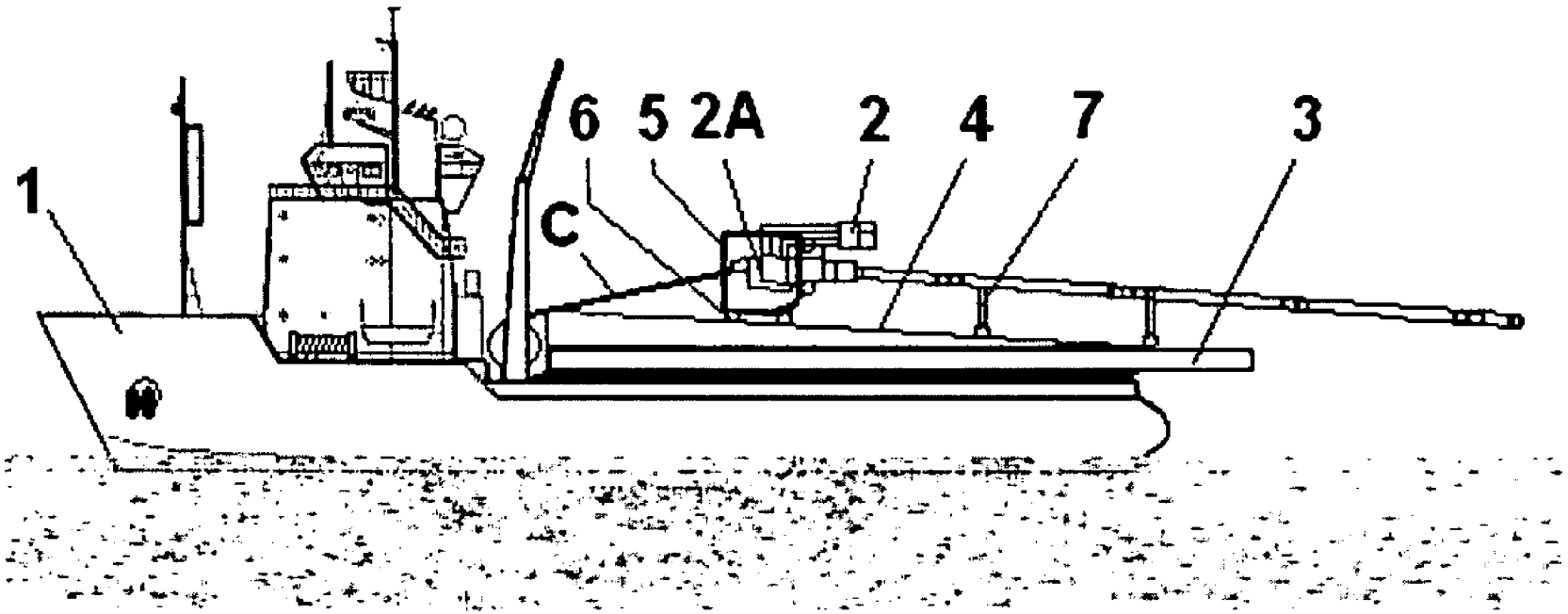
FIG. 2 shows the embodiment of FIG. 1, in which a subsea module has slid longitudinally on the inclined base, during the operation.
Figure 3:
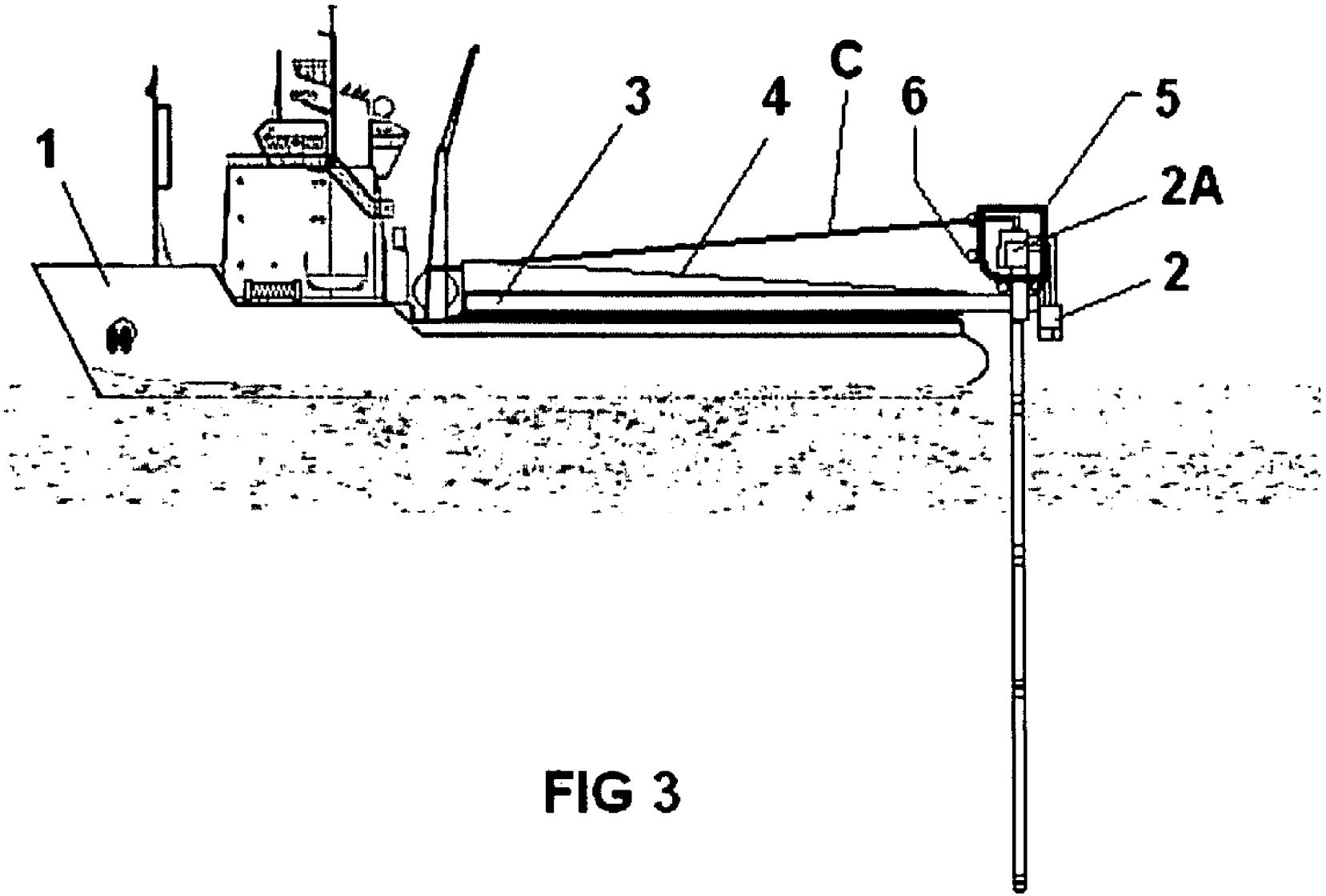
FIG. 3 shows the embodiment illustrated in FIGS. 1 and 2, in which the subsea is brought into vertical position at the end of the inclined base, ready for installation.

FIG. 1, FIG. 2 and FIG. 3 illustrate an exemplary embodiment of the system for underwater installation of a subsea module, including:

- a vessel (1) with a service deck for the transportation and installation of a subsea module (2);
- an inclined base (3), almost at a horizontal position, on the service deck, that supports the subsea module (2) with at least two guide channels (4);
- a portico (5), provided at the head (2A) of the subsea module (2), with rolling elements (6) that slide over the guide channels (4) of the base (3);
- a plurality of mobile supports (7), placed along the length of the subsea module (2), which have at their ends, in contact with the guide channels (4), mobile supports (6) of the same type found in the portico (5), to support and help with sliding the subsea module (2) over the guide channels (4) of the base (3).

Figure 4:
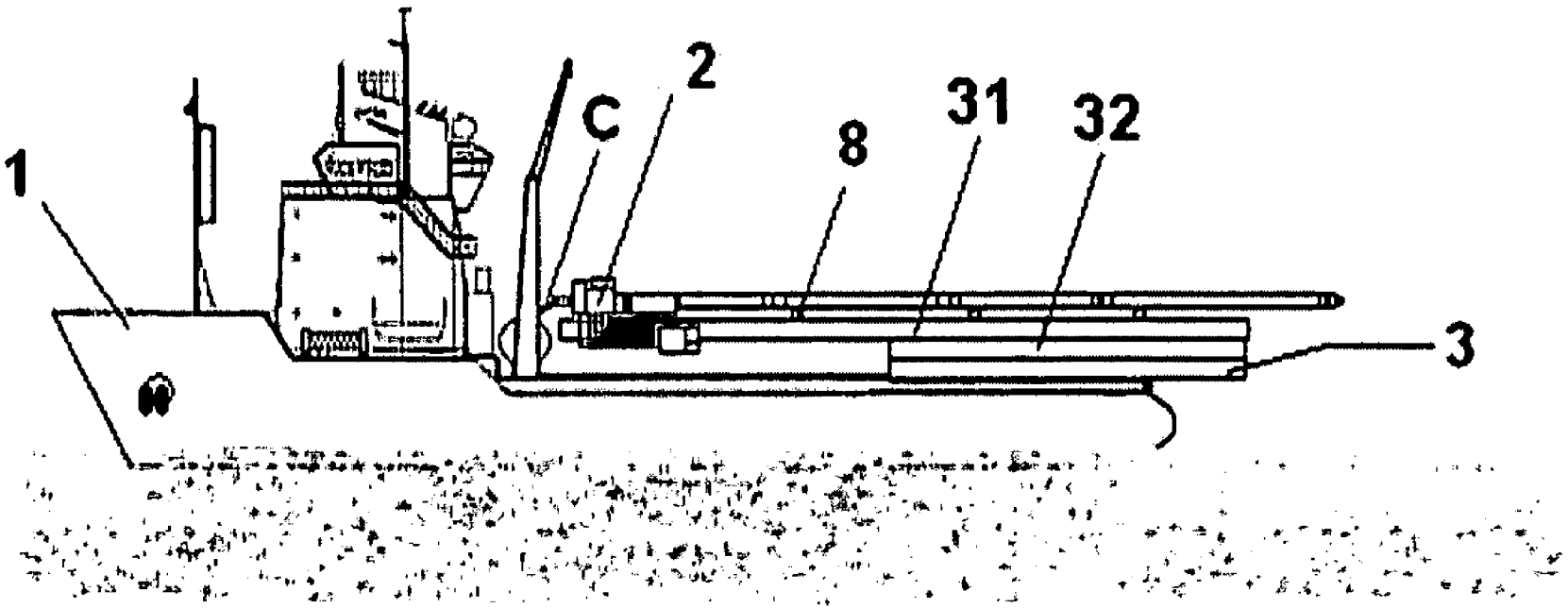
FIG. 4 illustrates a second exemplary embodiment with the subsea module on an articulated base (i.e., a horizontal position) on a an installation vessel.
Figure 5:
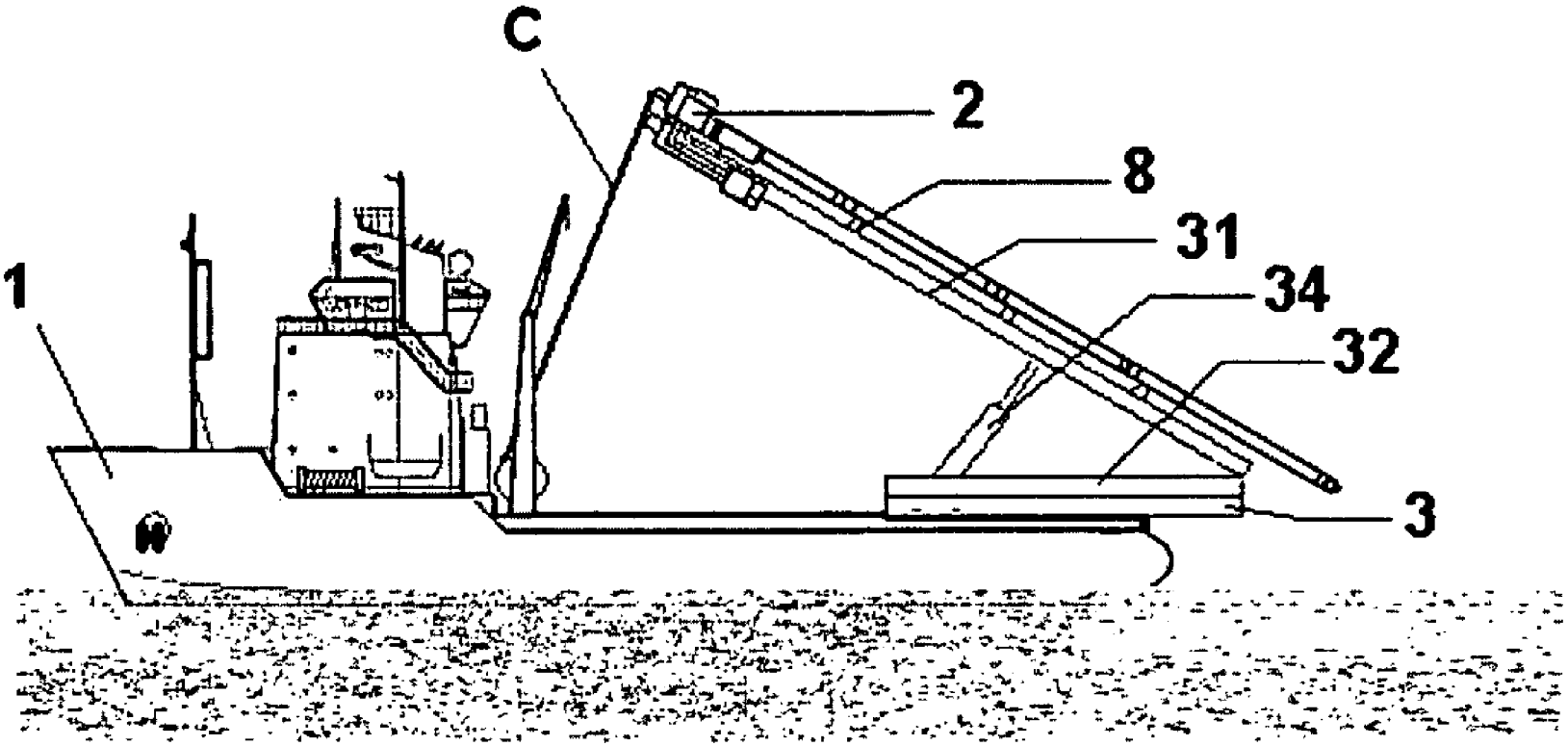
FIG. 5 shows the embodiment presented in FIG. 4, with the articulated base in an intermediate position during the operation.
Figure 6:
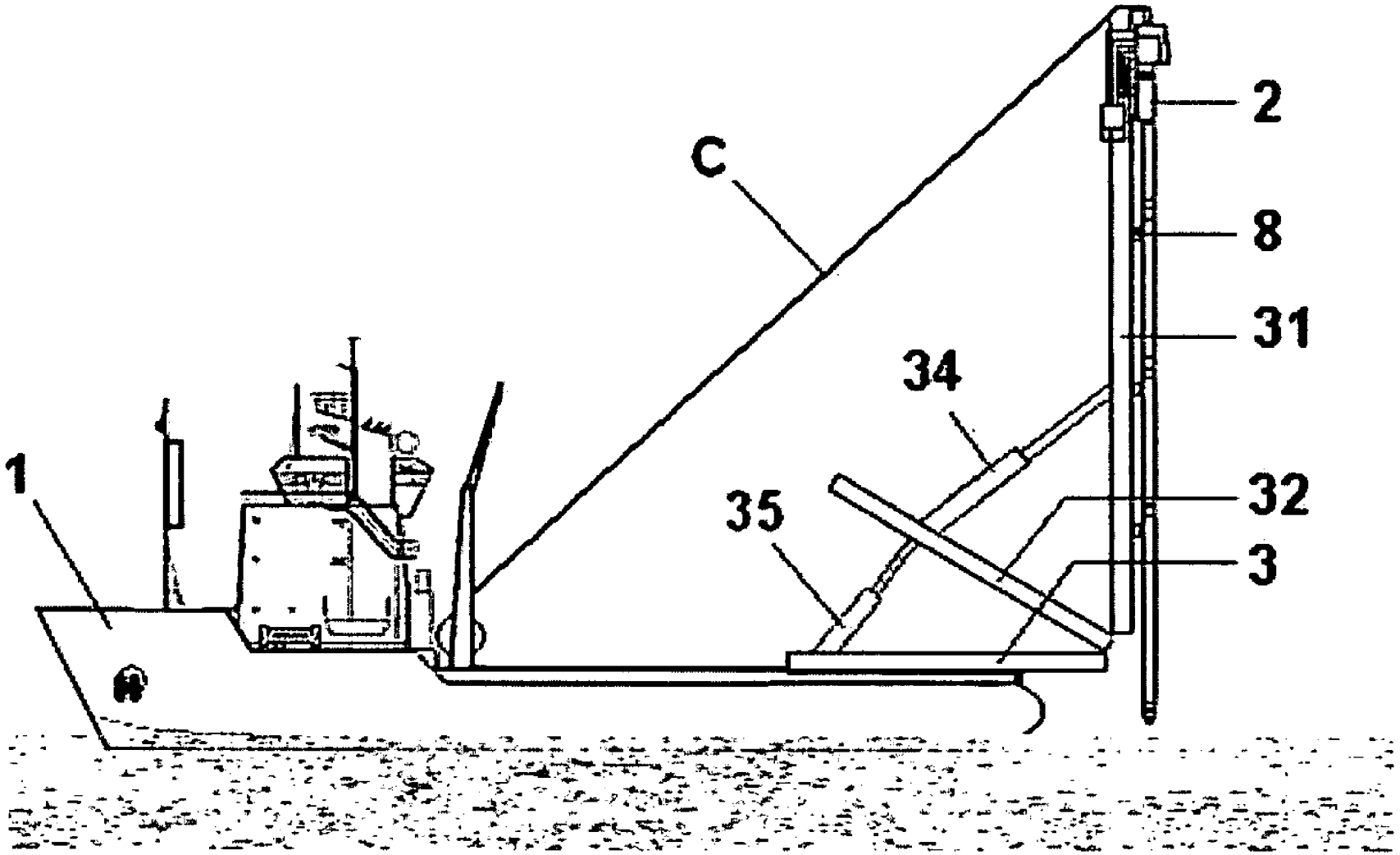
FIG. 6 shows the embodiment illustrated in FIGS. 4 and 5, in which the subsea module is brought into a vertical position together with the articulated base, ready for installation.

FIG. 4, FIG. 5 and FIG. 6 illustrate a second exemplary embodiment for underwater installation of a subsea module, including:

- a vessel (1) with a service deck, for the transportation and installation of a subsea module (2);
- a base (3) on the service deck of the vessel (1), that supports the subsea module (2) during the transportation, with at least two articulated arms, the first articulated arm (31) and the second articulated arm (32), being operated by a first hydraulic cylinder (34) and a second hydraulic cylinder (35), in such a way that the first articulated arm (31) comes to a vertical position in relation to the service deck of the transport vessel (1);
- a number of fixed supports (8) placed along the length of the first articulated arm (31) on which the subsea module (2) is supported, which serve as elements of support for the subsea module during the transportation and as guides for bringing the subsea module (2) to a vertical position.

Figure 7:
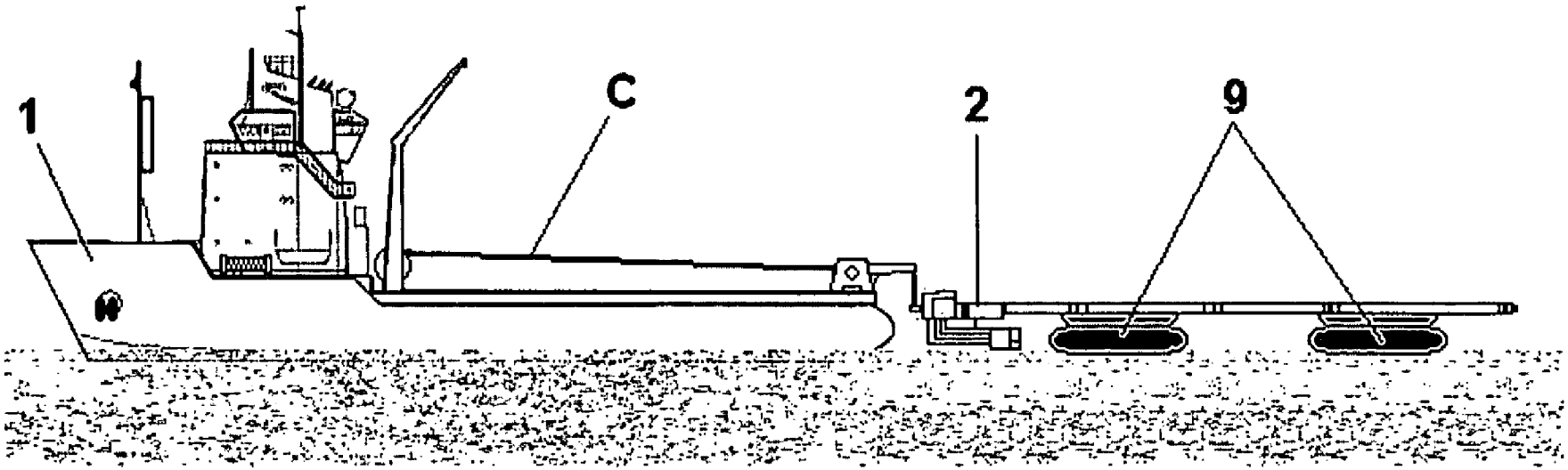
FIG. 7 illustrates a third exemplary embodiment with the subsea module towed by a vessel, floating over buoys to the location for installation.
Figure 8:
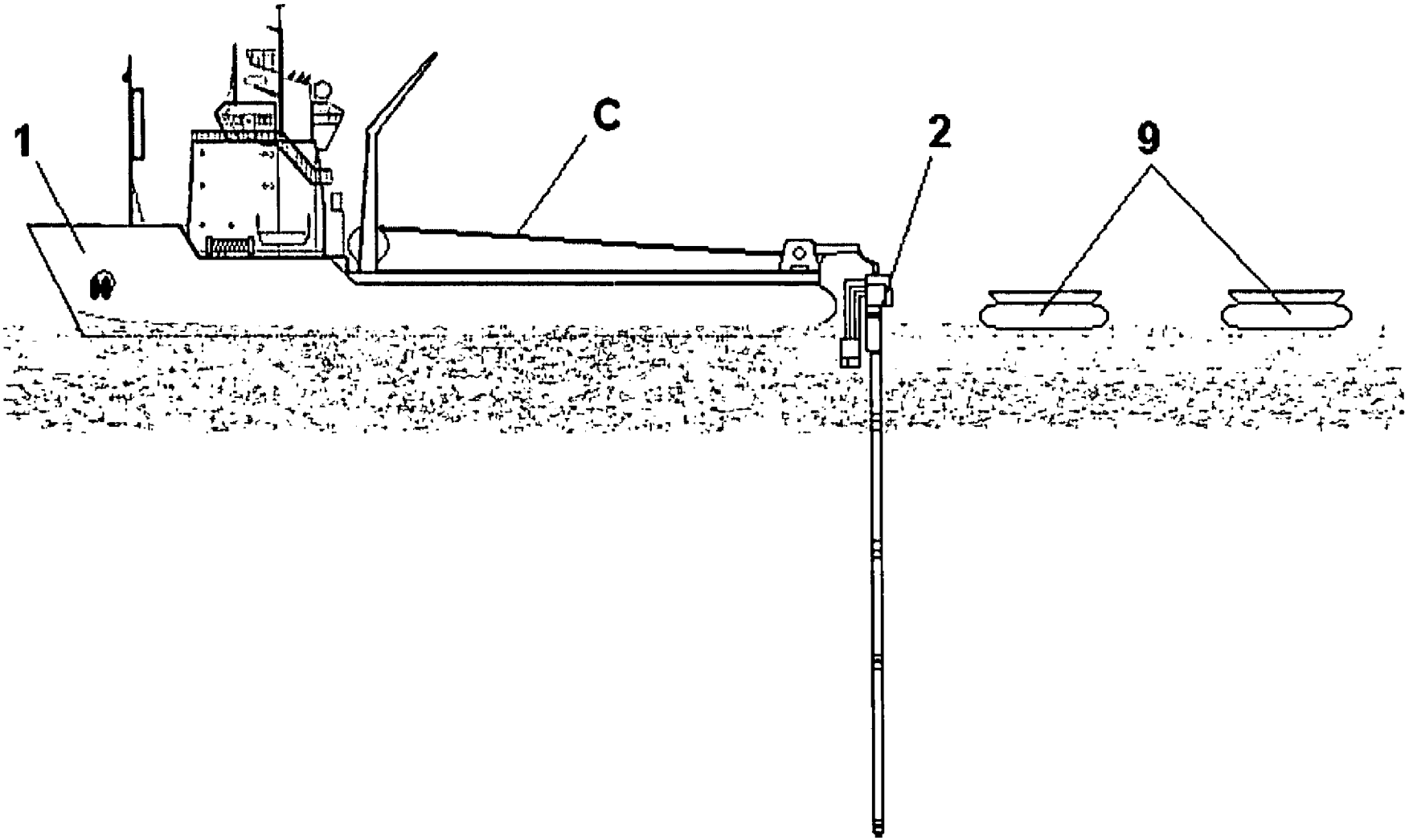
FIG. 8 shows the embodiment presented in FIG. 7, in which the subsea module is brought into a vertical position hung by a cable, ready for installation.

FIG. 7 and FIG. 8 show the representation of a third exemplary embodiment for underwater installation of a subsea module, including:

- a vessel (1) with a service deck for the transportation and installation of a subsea module (2);
- a plurality of floating supports (9) placed along the length of the subsea module (2), which support the subsea module (2) and allow the vessel (1) to tow the subsea module.

Figure 9:
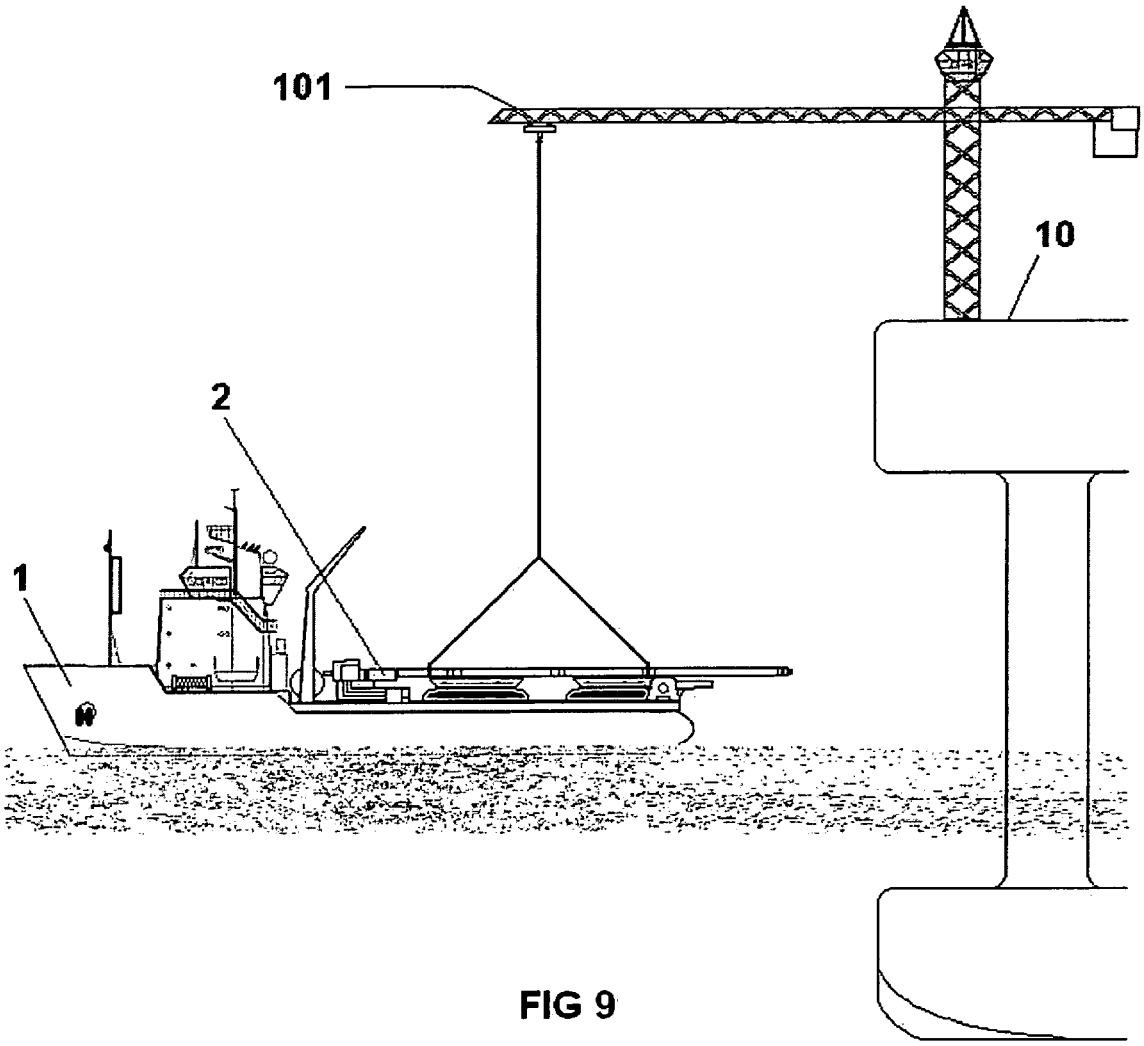
FIG. 9 illustrates a fourth exemplary embodiment with a subsea module on a vessel and a crane installed in a floating structure nearby the vessel for the operation.
Figure 10:
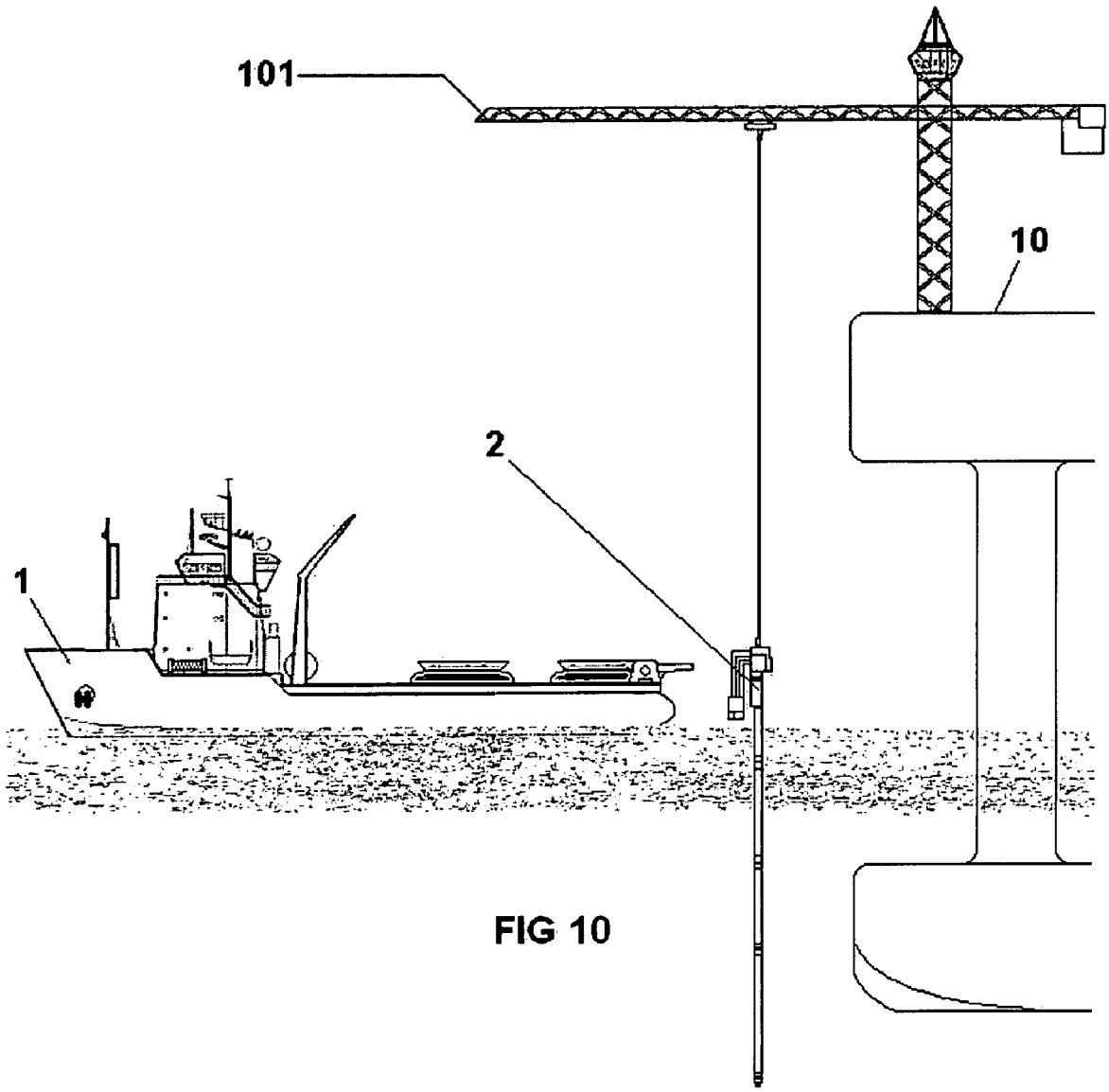
FIG. 10 shows the embodiment presented in FIG. 9, in which the subsea module is brought into a vertical position hung by the crane, ready for installation.

FIG. 9 and FIG. 10 illustrate a fourth exemplary embodiment for the installation of a subsea module, including:

- a vessel (1) with a service deck for transportation and installation of a subsea module (2);
- a floating structure (10) that, by means of a crane (101), brings the subsea module (2) to the vertical position and retrieves the subsea module from the vessel (1) for installation.

Figure 11:
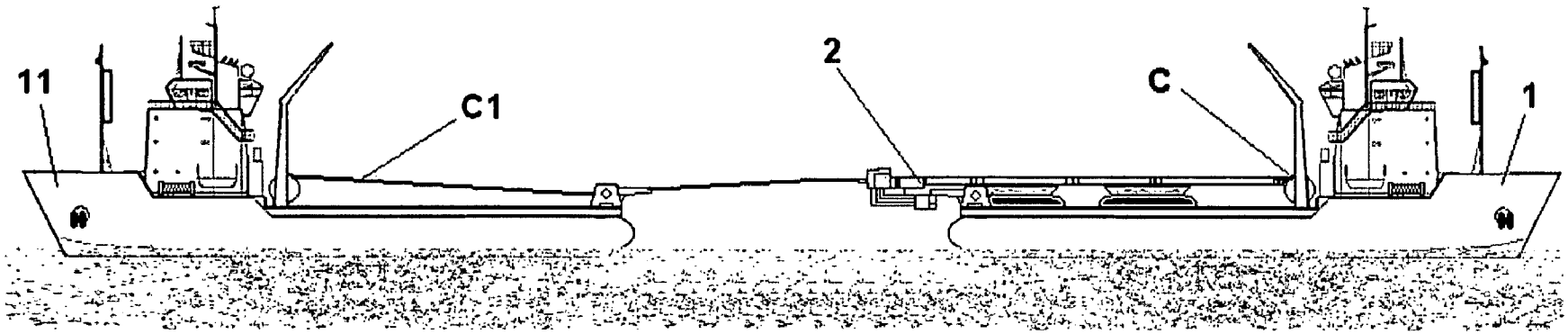
FIG. 11 illustrates a fifth exemplary embodiment with a subsea module on a vessel and a second vessel for withdrawing the module.
Figure 12:
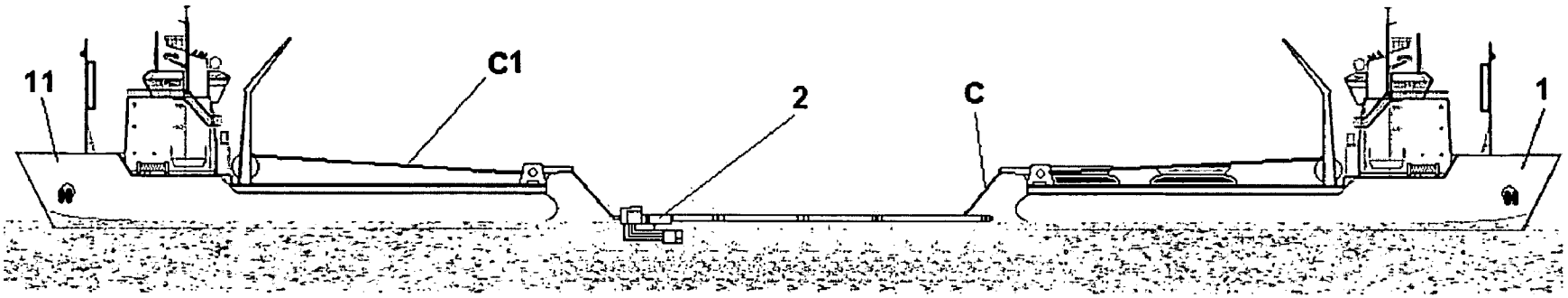
FIG. 12 shows the embodiment presented in FIG. 11, in which the subsea module is hung in the horizontal position, between the two vessels in the operation.
Figure 13:
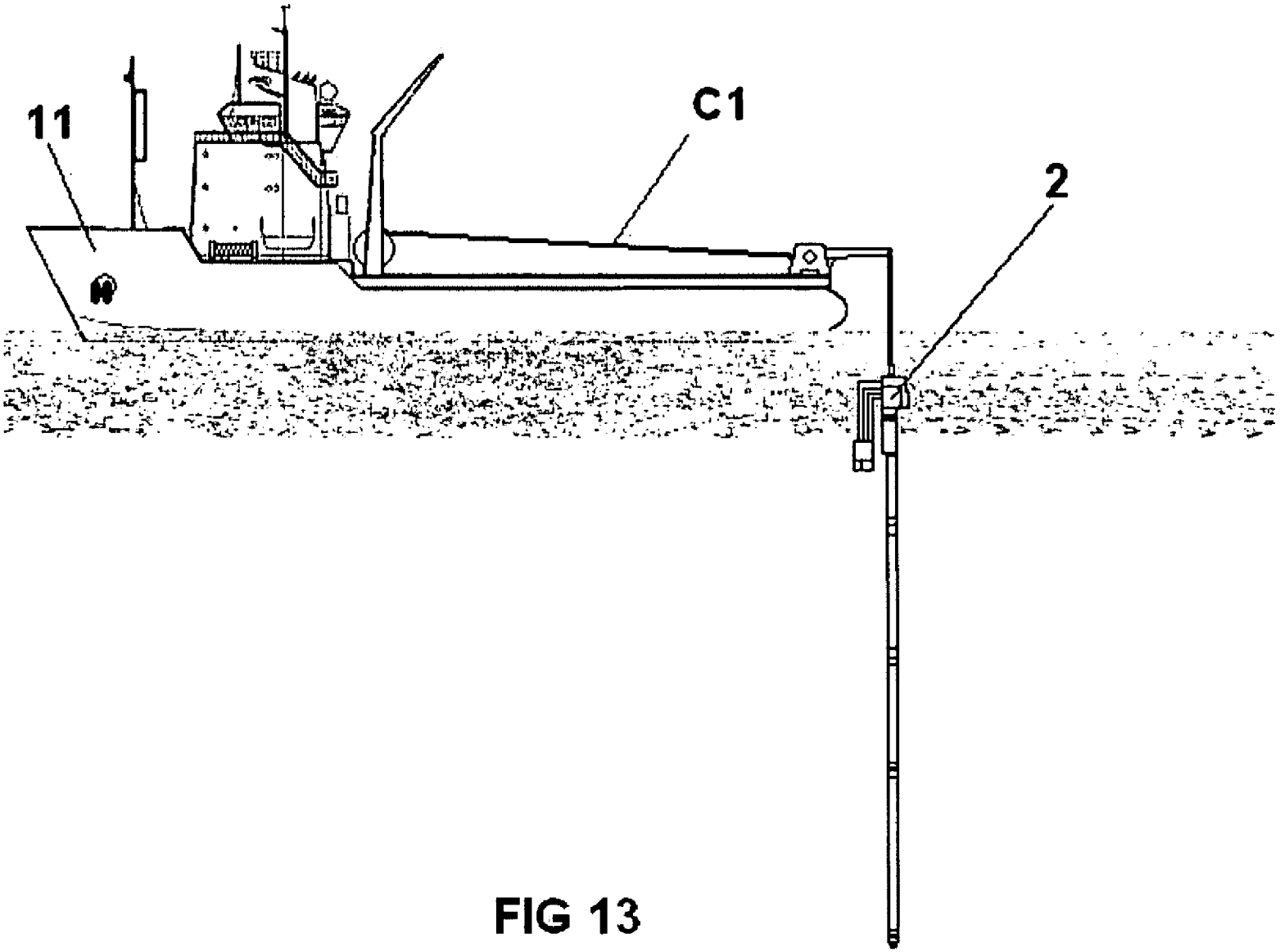
FIG. 13 shows the embodiment illustrated in FIGS. 11 and 12, in which the subsea module is in a vertical position, ready for installation.

FIG. 11, FIG. 12 and FIG. 13 illustrate a fifth exemplary embodiment for installation of a subsea module, including:

- a vessel (1), for transportation and installation of a subsea module (2);
- a second vessel (11) with a second cable, for withdrawing of the subsea module (2) from the vessel (1) and for descending this module (2) by means of a cable (C1).

Figure 14:
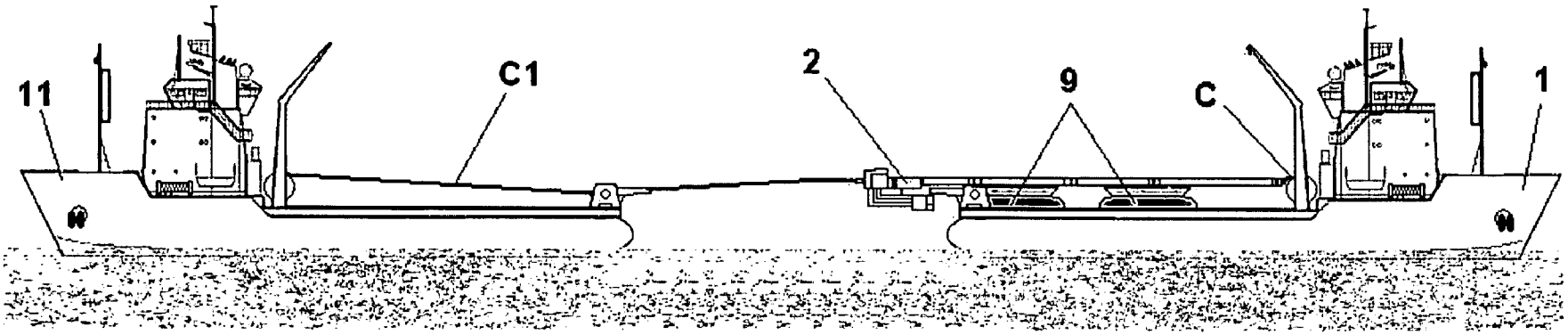
FIG. 14 illustrates a sixth exemplary embodiment with a subsea module on a vessel, supported over floats and a second vessel for withdrawing the module.
Figure 15:
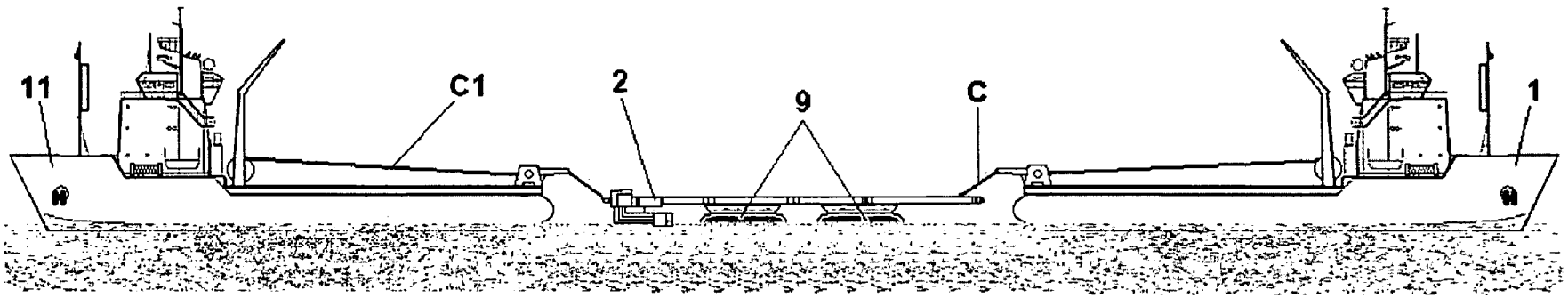
FIG. 15 shows the embodiment illustrated in FIG. 14, in which the subsea module is held in a horizontal position supported on the floats and held between the vessels during the operation.
Figure 16:
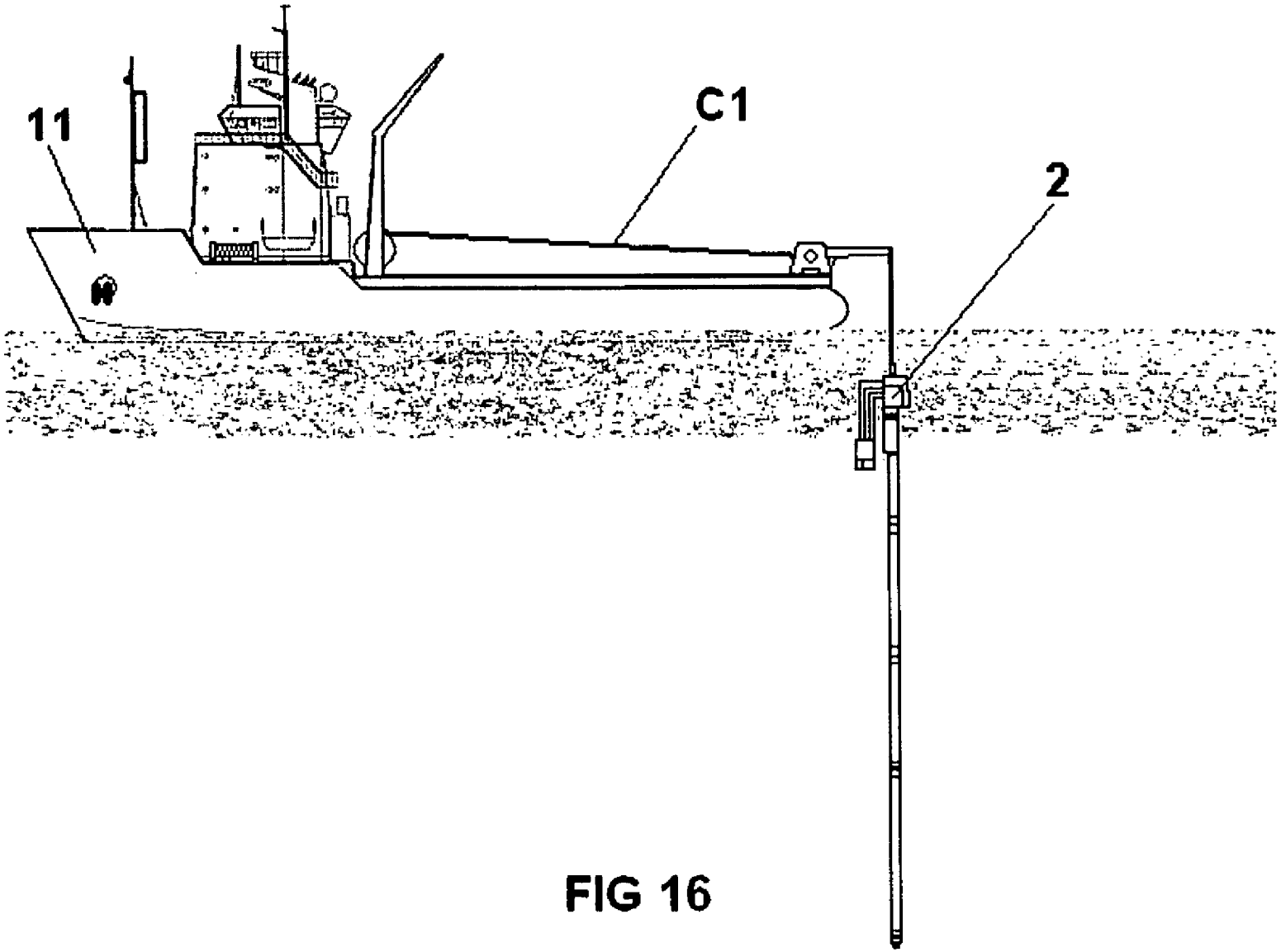
FIG. 16 shows the embodiment illustrated in FIGS. 14 and 15, in which the subsea module is in a vertical position, ready for installation.

FIG. 14, FIG. 15 and FIG. 16 show a sixth exemplary embodiment for underwater installation of a subsea module, wherein:

- a vessel (1), for transportation and installation of a subsea module (2);
- a second vessel (11), for withdrawing the subsea module (2) from the vessel (1) and for descending it by means of a cable (C1);
- a plurality of floats (9) placed along the length of the subsea module (2) to support the subsea module by flotation on the surface of the sea, thus minimizing the influence of the heave caused by waves during the operations of towing and descending the module.

Figure 17:
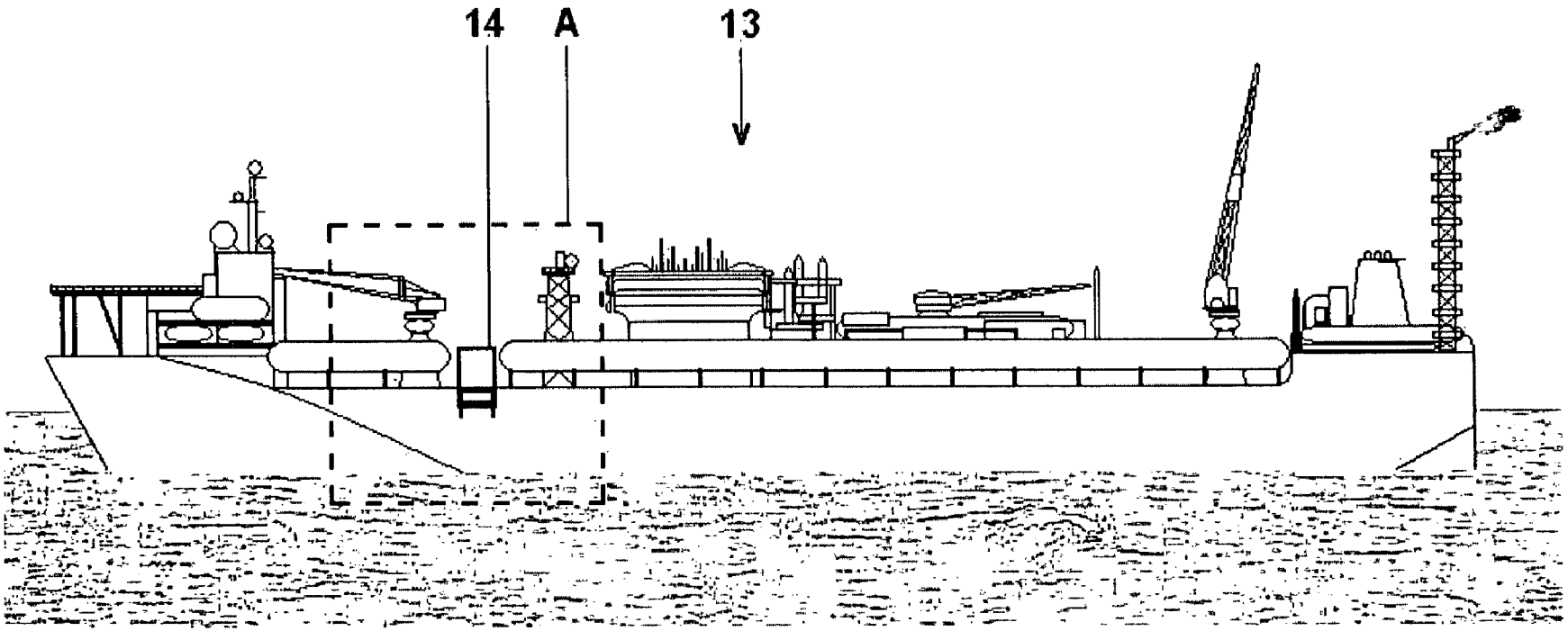
FIG. 17 illustrates a seventh exemplary embodiment of the system in which a production vessel with a structure, similar to a balcony, is provided at the side of an oil production vessel, shown in the dotted area (A).
Figure 18:
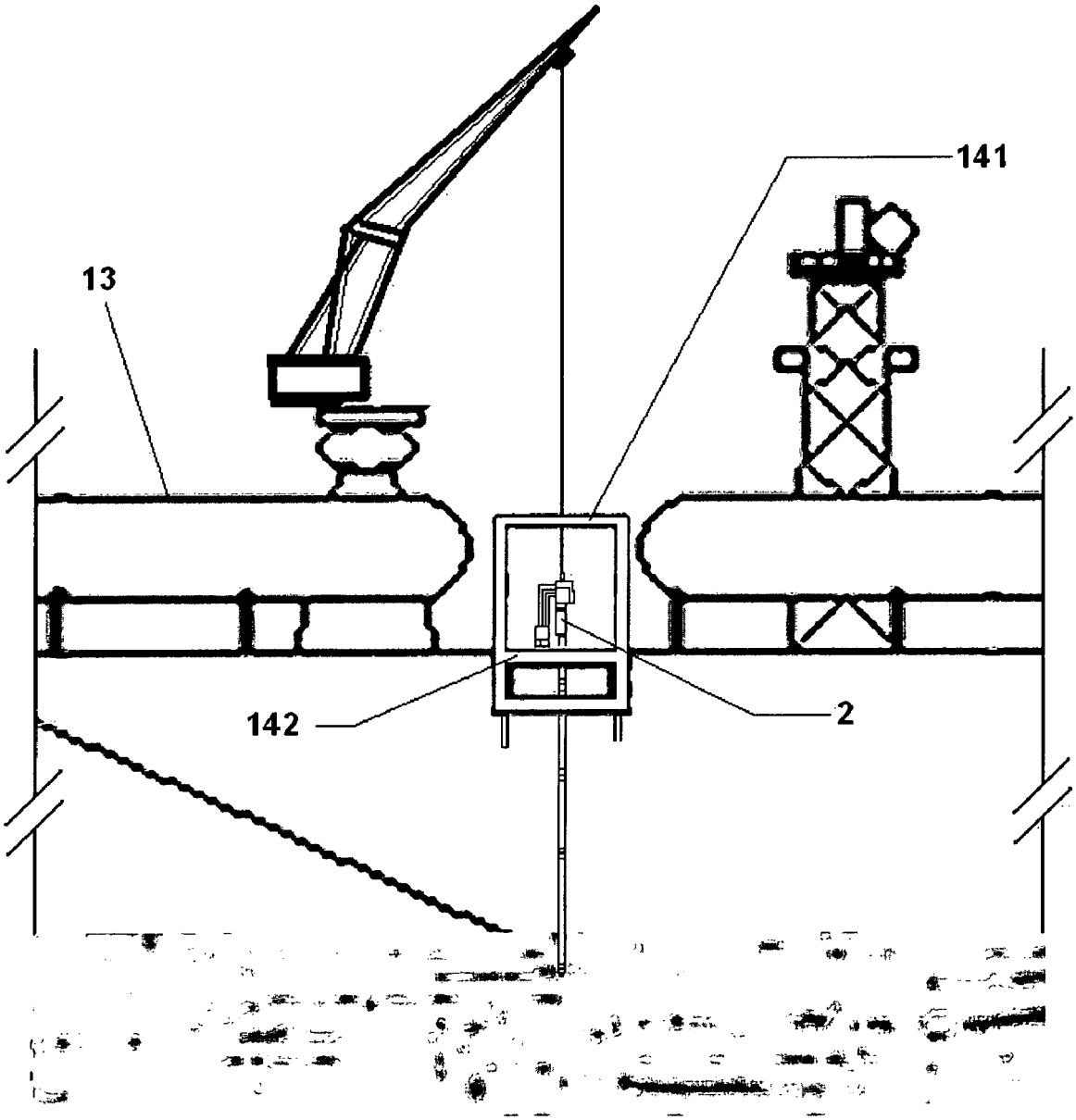
FIG. 18 shows the dotted area (A) of FIG. 17.
Figure 19:
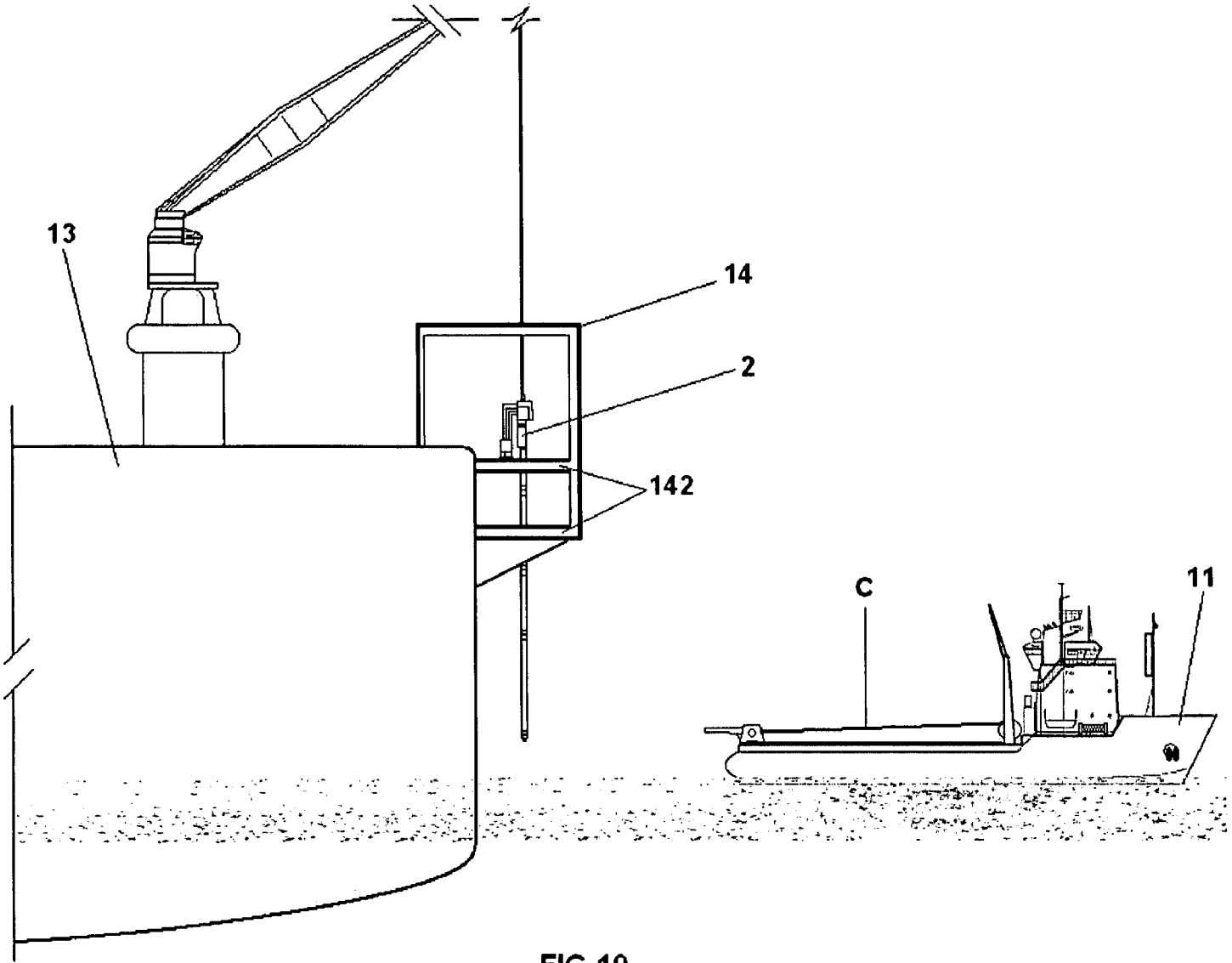
FIG. 19 shows a side view of the floating structure of FIGS. 17 and 18 with the subsea module brought into a vertical position and the vessel with a cable positioned nearby.
Figure 20:
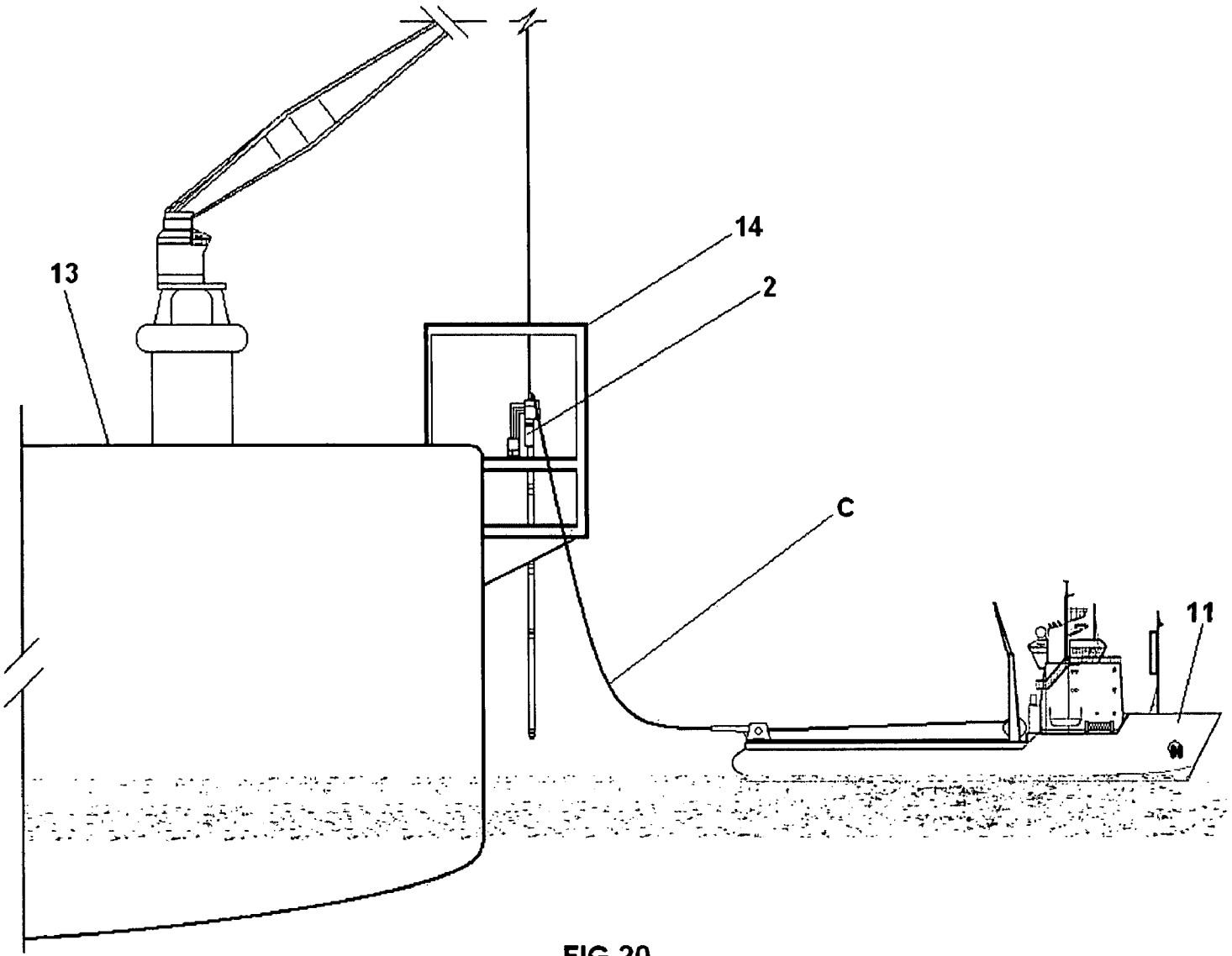
FIG. 20 shows the side view of the structure of FIGS. 17 and 18, in which a cable from the vessel is connected to the subsea module positioned in the structure of the oil production vessel.
Figure 21:
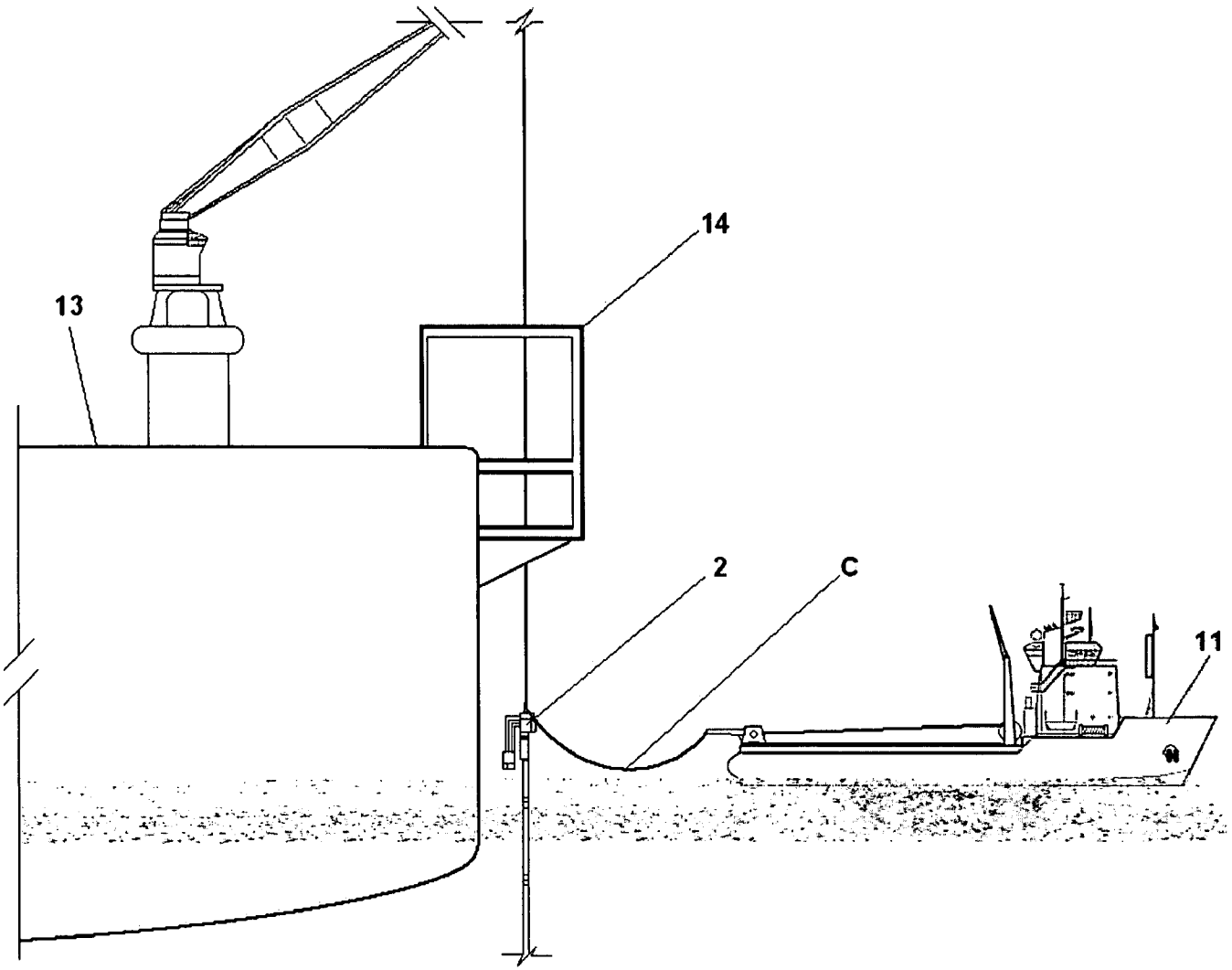
FIG. 21 shows a side view of the structure of FIGS. 17 and 18, with the subsea module descending in the vertical position, hanging by cables.
Figure 22:
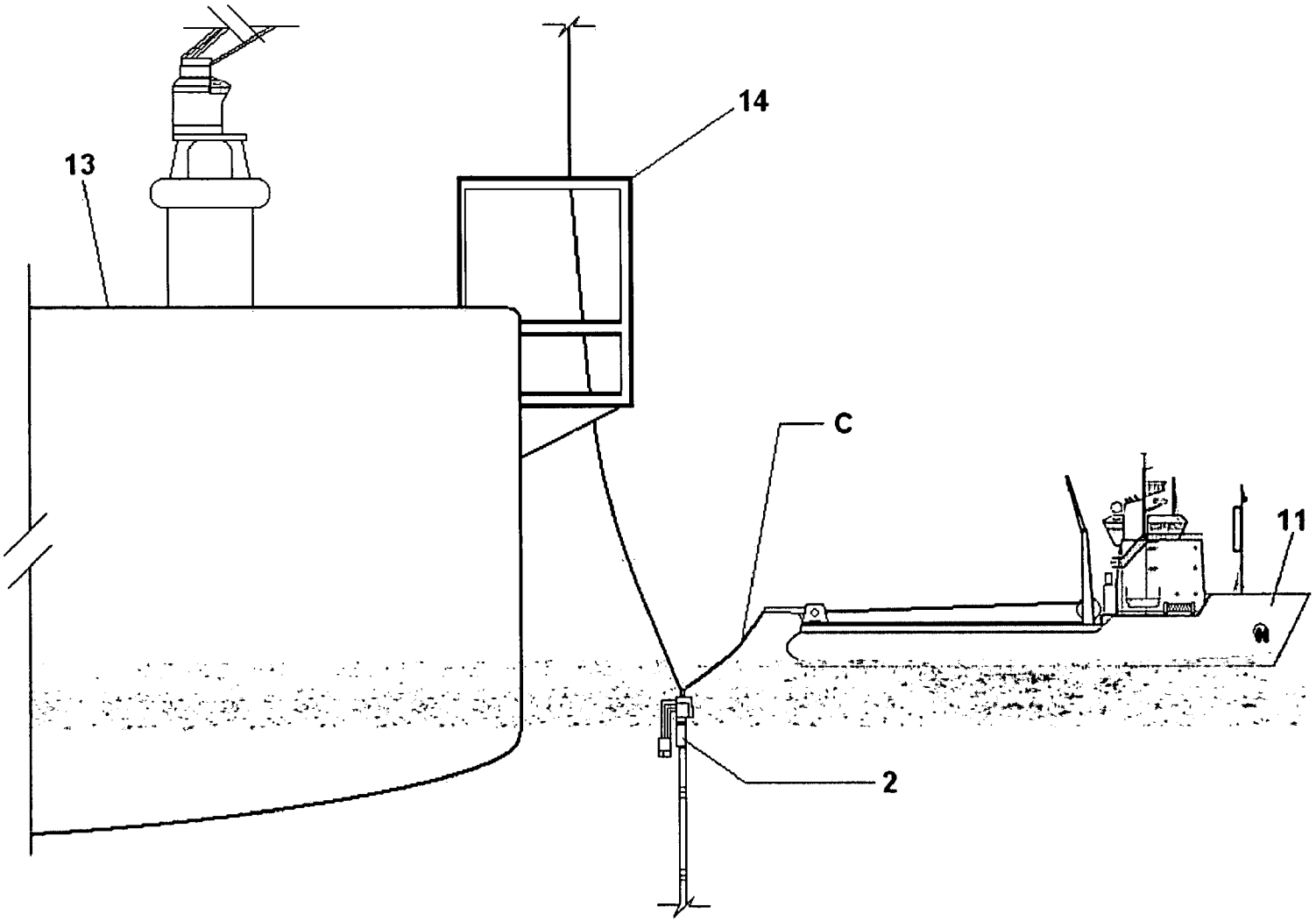
FIG. 22 shows a subsea module brought into the sea, hanging by cables.
Figure 23:
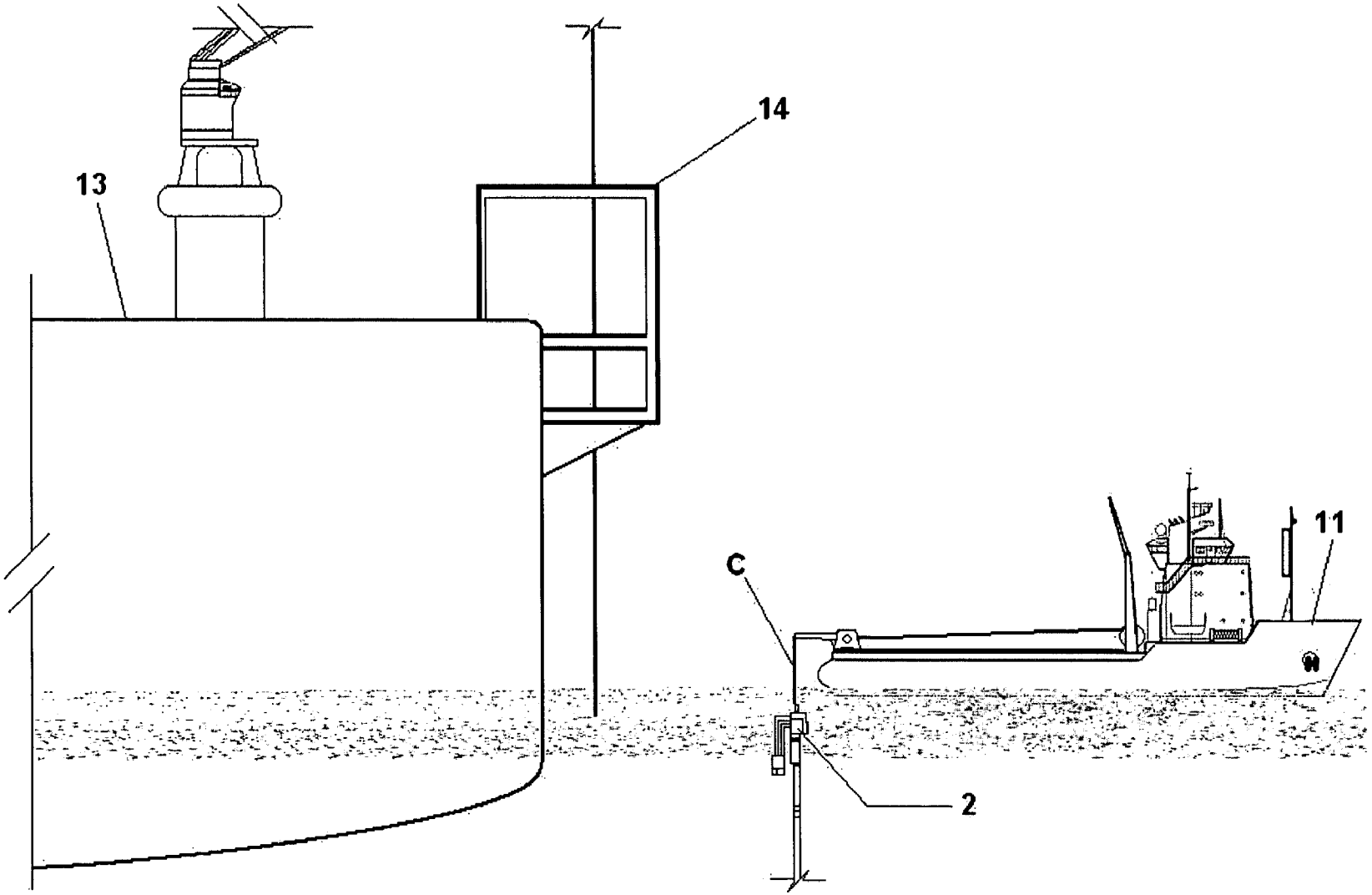
FIG. 23 shows a subsea module in the sea hanging by a cable, ready for installation.

FIGS. 17 to 23 show a seventh exemplary embodiment for underwater installation of a subsea module, including:

- a simple vessel (11), for installation of a subsea module (2);
- a production vessel (13) with a structure (14), similar to a balcony, for assembling or disassembling a subsea module on the deck of the vessel, while at sea (FIG. 17);
- an assembly and repair structure (14), indicated within the dotted area (A) of FIG. 17, which is mounted rigidly on one of the sides of the vessel (13), for assembling and disassembling the module and helping in the operation of transfer to the vessel (1) for installation, including: a structural element (141), basically a cube shape, empty, with approximately one-third of the length of one of its longest sides rigidly fixed to the upper part of the side of the vessel (13), having, at least, a horizontal floor (142) to manipulate and fix the subsea module (2).

Figure 24:
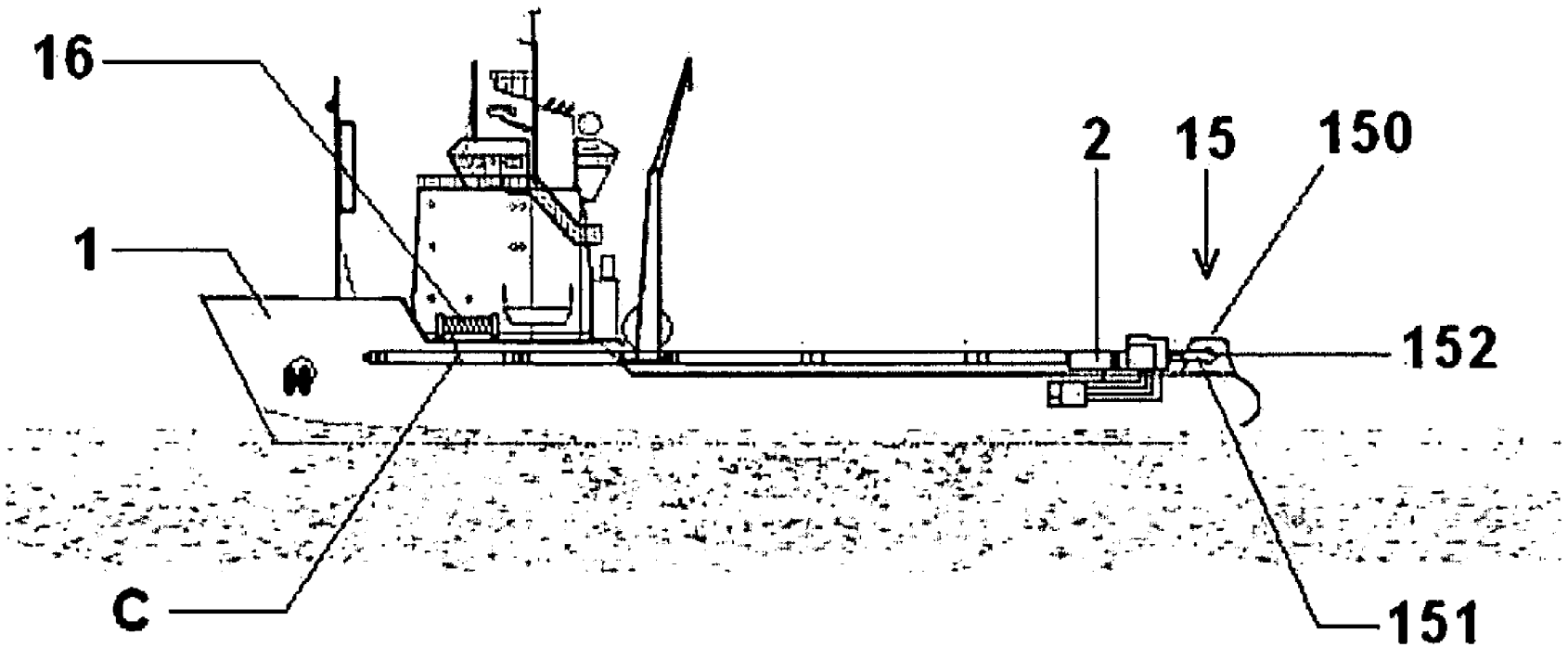
FIG. 24 shows an eighth exemplary embodiment of the system in which a the subsea module fixed to the side of a vessel, in a horizontal position.
Figure 25:
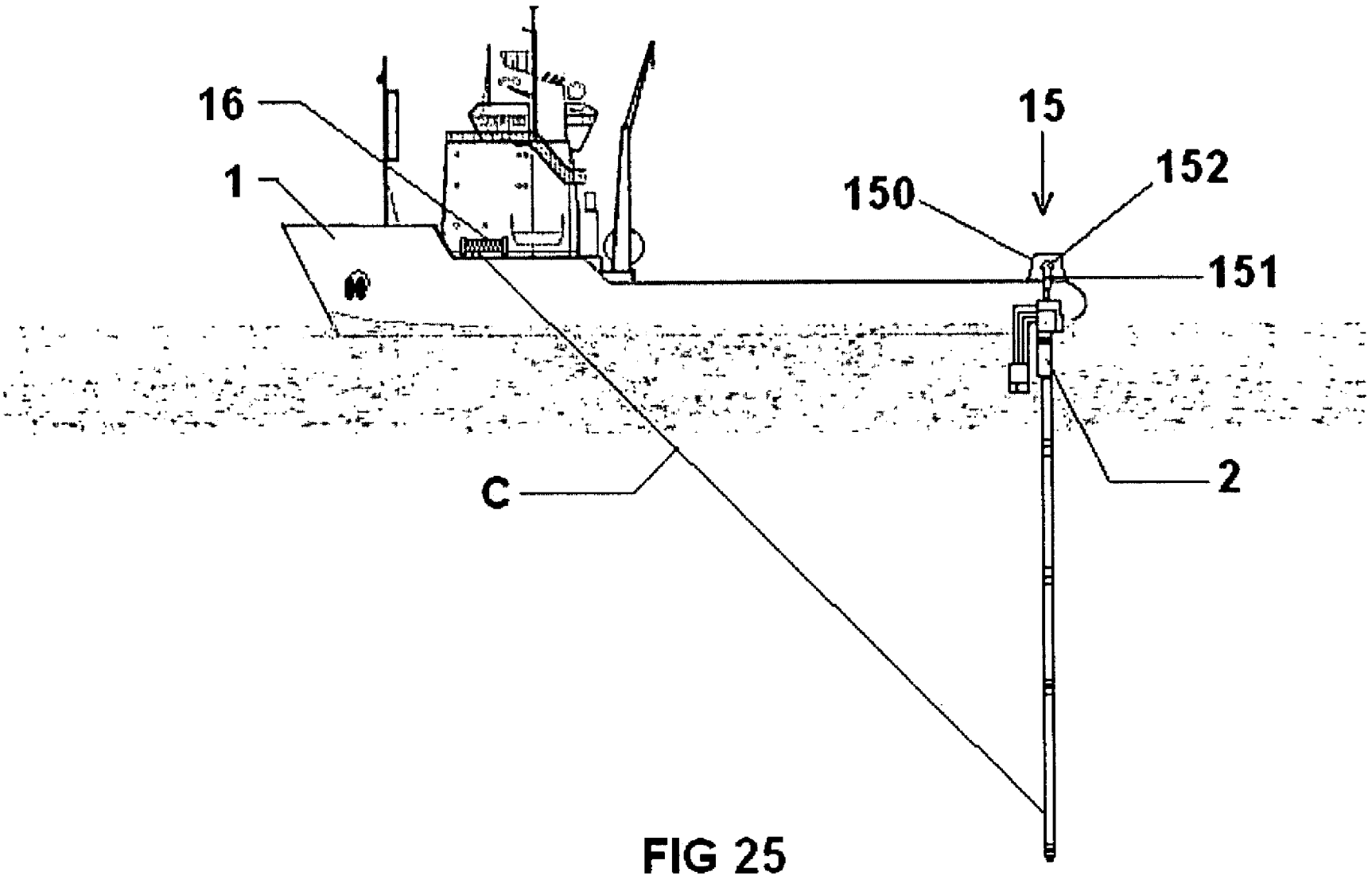
FIG. 25 shows the subsea module moved to a vertical position by a cable from the vessel.

FIG. 24 and FIG. 25 illustrate an eighth exemplary embodiment for underwater installation of a subsea module, including:

a simple vessel (1) for transportation and installation of a subsea module (2);

a rotating support (15), preferably installed on the stern of the vessel (1) with a motor module (150) rigidly fixed to the deck of the vessel (1), an arm (151) aligned along the side of the vessel (1), connected to an axle (152) of the motor module (150) at one of its ends and, at the other end, linked to the subsea module (2), the other end of the subsea module being linked to a crane (16) of the vessel (1) by means of a cable (C) for descending the subsea module into the sea.

Figure 26:
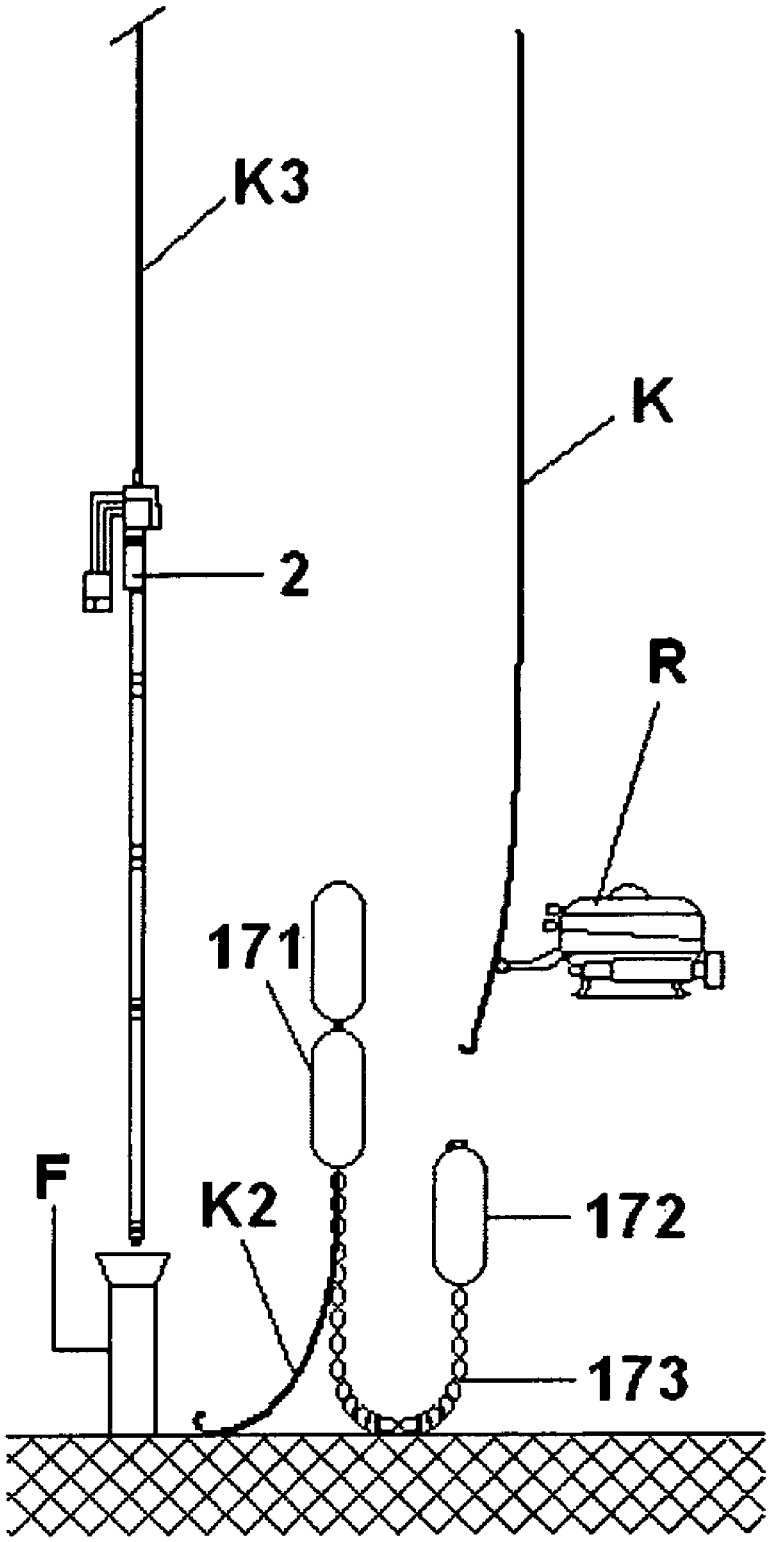
FIG. 26 illustrates the use of a counterbalancing device to reduce the heave during the installation of a subsea module.
Figure 27:
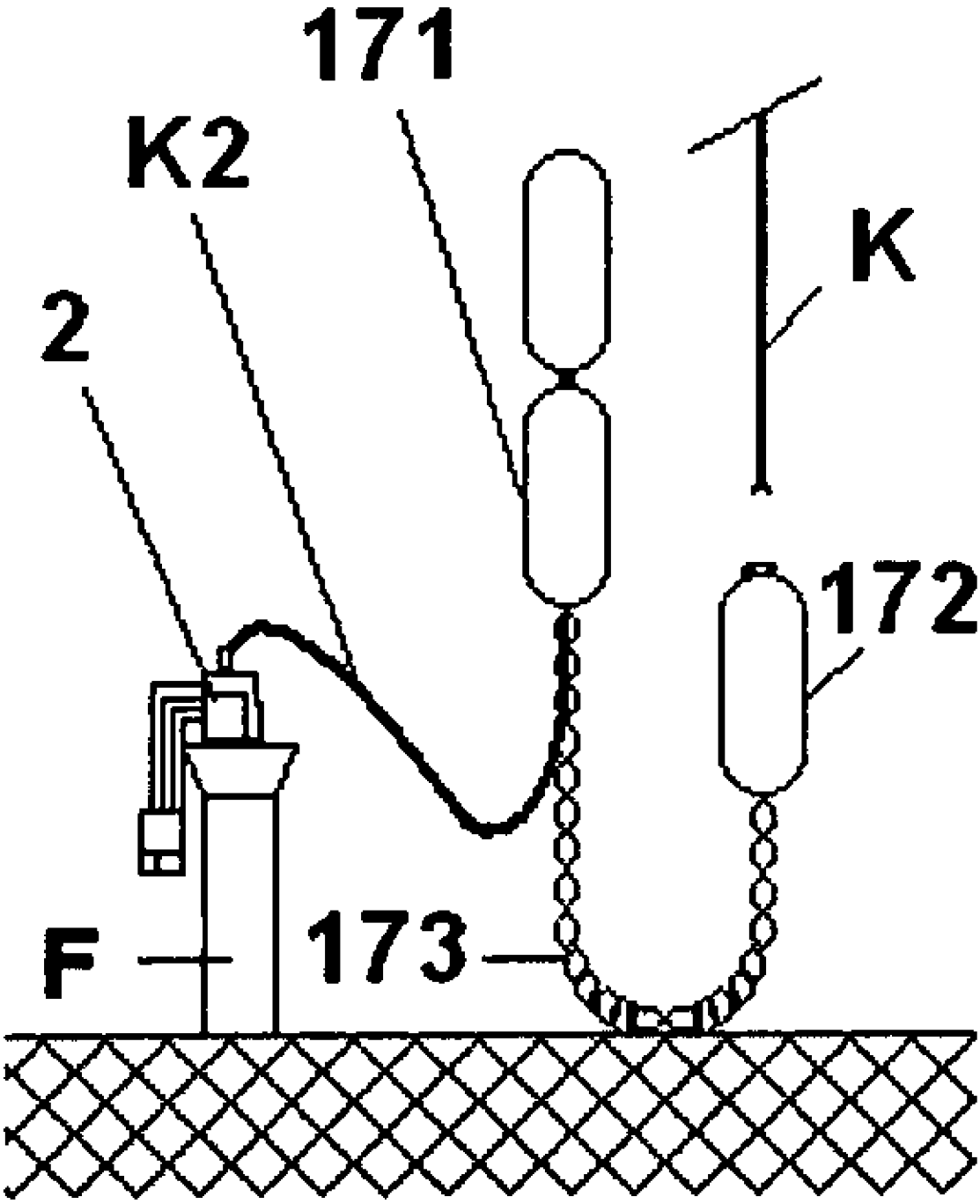
FIG. 27 shows the counterbalancing device of FIG. 26 coupled to a subsea module installed in a lined borehole F.
Figure 28:
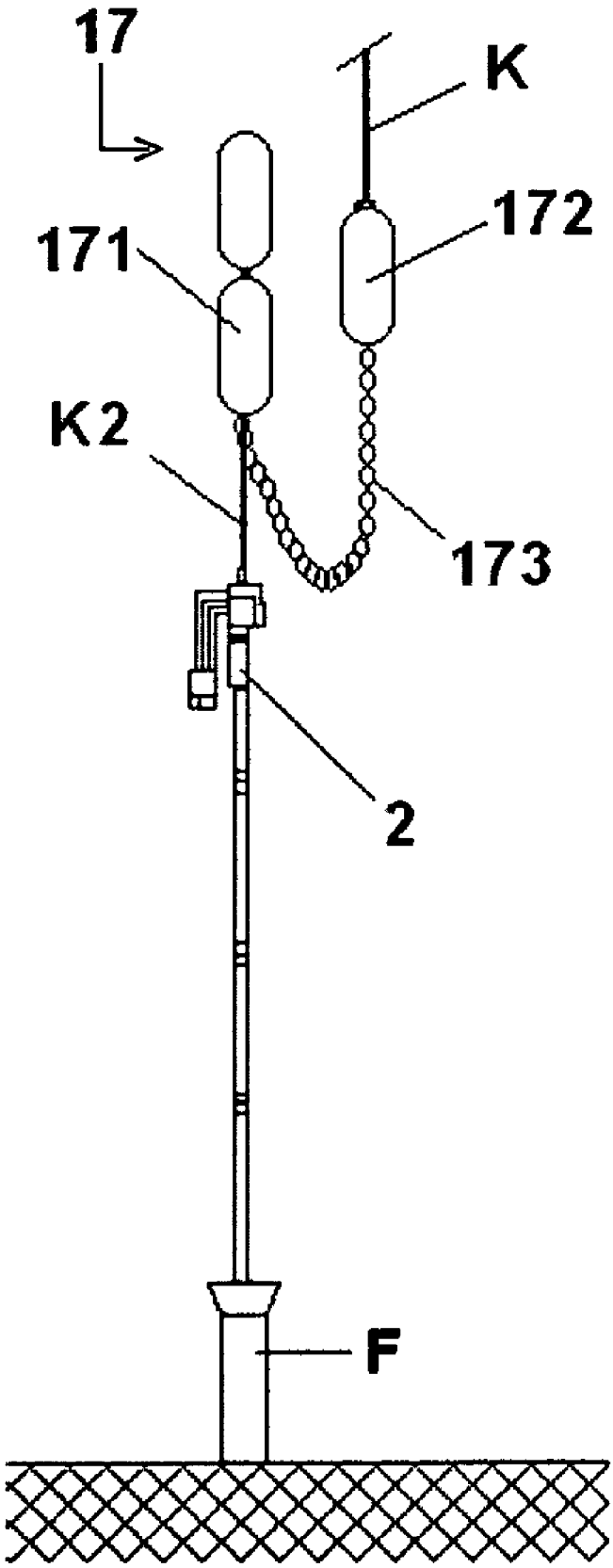
FIG. 28 shows the counterbalancing device of FIG. 26 coupled to a subsea module during the withdrawal.

FIG. 26, FIG. 27 and FIG. 28 illustrate a counterbalancing device, applicable to any one of the exemplary embodiments of the system for a subsea module installation. The counterbalancing device reduces the movement induced by the sea during the installation of a subsea module, thus reducing the influence of the movement of the surface of the sea caused by heaving during the installation, resulting in a smooth descent and avoiding any shock impacts between the connector (not shown) on the subsea module (2) and the areas of sealing (not shown) of the lined borehole (F) on the seabed, which might cause structural damage. The counterbalancing device shown in FIG. 26 includes:

at least one buoy (171) floating close to neutral point, to support the weight of the subsea module (2), linked at its lower end to the head of the subsea module (2) by a sustaining cable (K1);

a second buoy (172) to control and interface the subsea module (2) and the vessel (1) in operations of descending or ascending the subsea module (2), linked to the vessel (1) by a traction cable (K) fixed to the upper part of the second buoy (172), and linked by its lower part to the first buoy (171), by chains (173).

The coupling between the counterbalancing device and the subsea module (2) can be carried out by a remote operated vehicle (R).

The counterbalancing device can be positioned on the seabed before installation of the subsea module (2) (FIG. 27), can be transported together with the subsea module (2) in the vessel (1), or can be launched immediately before or after the installation of the subsea module (2).

Figure 29:
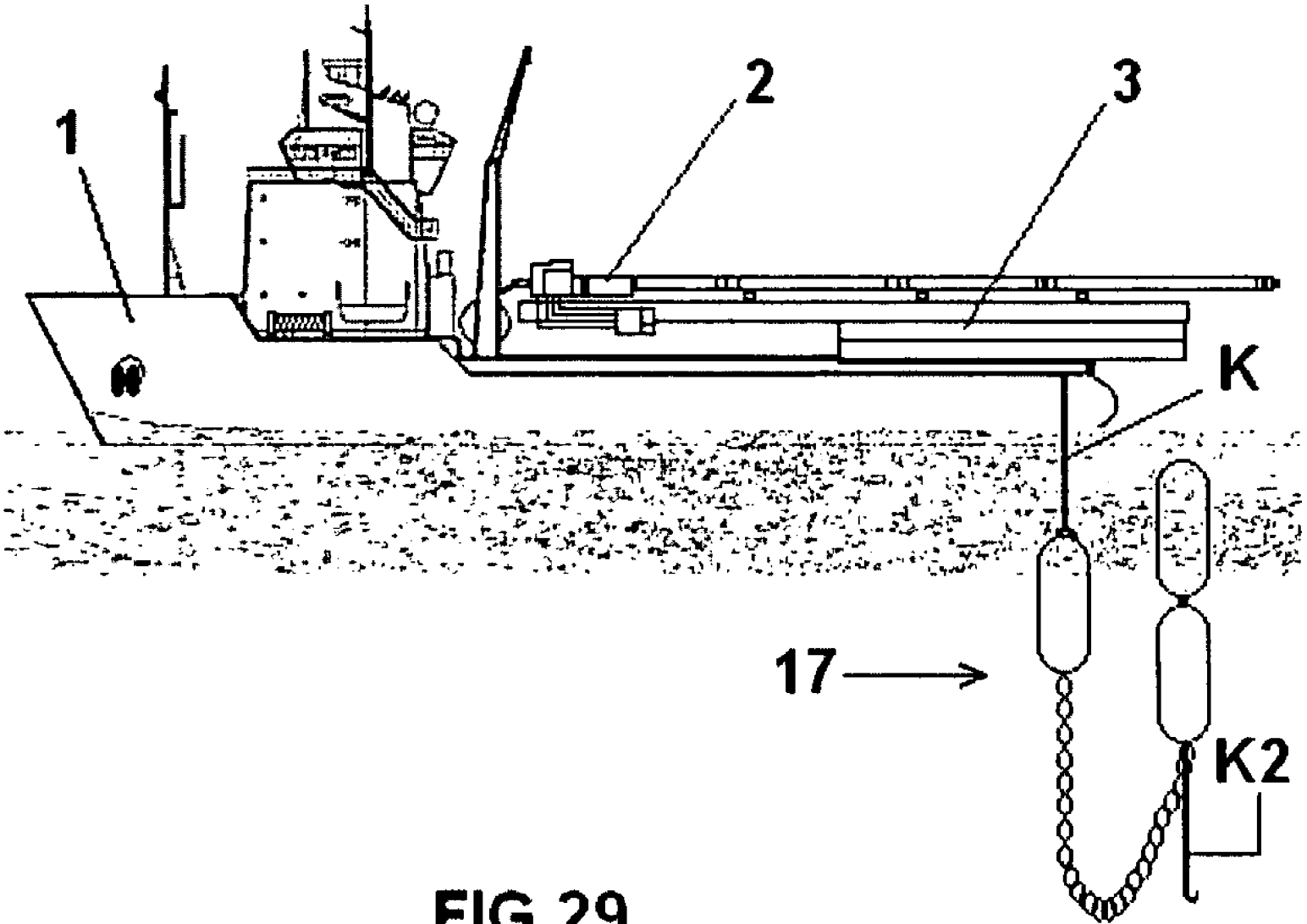
FIGS. 29 and 30 show the counterbalancing device used with the system of FIG. 4 for installation of a subsea module.
Figure 30:
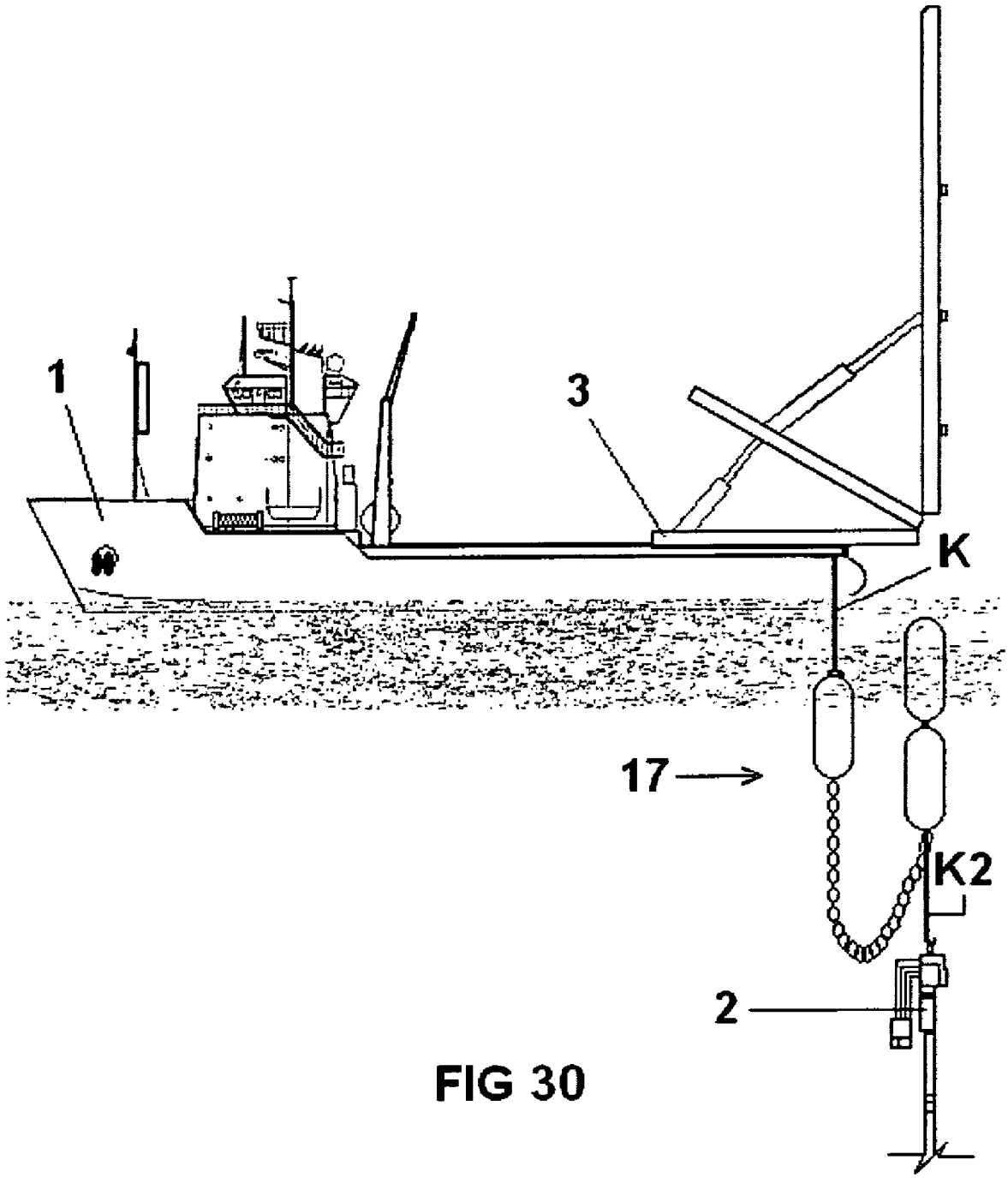

As an example, a practical application of the counterbalancing device (17) can be seen in FIGS. 29 and 30 for the second exemplary embodiment.

From here, the methods relating to each of the exemplary embodiments will be described with in order.

For the first exemplary embodiment, the method comprises the following steps with reference to the drawings of FIG. 1-3:

a) assemble a subsea module with mobile supports along its length in a portico with rolling elements to provide an assembly;

b) transfer the assembly to an inclined base with guide channels, on the service deck of a vessel, in such a way that the mobile supports and the rolling elements are aligned with the guide channels and fix the assembly to the vessel, by a cable;

c) transport the assembly to the location for installation on the seabed;

d) release the cable in such a way that the assembly slides over the guide channels in the direction of the stem of the vessel, withdrawing the mobile supports as they reach the end of the guide channels;

e) rotate the portico when it reaches the end in such a way that the subsea module comes to a vertical position;

f) disassemble the subsea module from the portico; and g) descend the subsea module, in the vertical position into the sea, by releasing the cable.

For the second exemplary embodiment, the method comprises the following steps, with reference to FIGS. 4-6:

a) transfer a subsea module to a base on the service deck of a vessel in such a way that the subsea module is fixed to fixed supports, on top of a first articulated arm aligned with the length of the subsea module, and to the vessel by a cable;

b) transport the subsea module to the location for installation on the seabed;

c) release the cable as the first articulated arm is being raised together with the second articulated arm, up to approximately more than half of a right angle, by hydraulic cylinders;

d) continue releasing the cable for allowing the subsea module to come to a vertical position;

e) uncouple the subsea module from the fixed supports; and f) descend the subsea module by releasing the cable, in the vertical position into the sea.

For the third exemplary embodiment, the method comprises the following steps with reference to FIGS. 7-8:

a) fix several floating supports to a subsea module on the service deck of a vessel, the floating supports supporting the subsea module on the sea surface allowing the vessel to tow the subsea module by a cable;

b) transport the subsea module to the location for installation on the seabed;

c) uncouple the subsea module from the floating supports, allowing the subsea module to come to a vertical position; and d) descend the subsea module by releasing the cable, in the vertical position into the sea.

For the fourth exemplary embodiment, the method comprises the following steps with reference to FIGS. 9-10:

a) assemble the subsea module on supports or directly on the service deck of a vessel, fixing the subsea module to the vessel by cable;

b) transport the subsea module to the location for installation on the seabed, where there is a floating structure with a crane;

c) couple the crane to the subsea module to raise the subsea module from the service deck;

d) hang the subsea module in vertical position using the crane; and e) descend the subsea module, by releasing the cable, in vertical position into the sea.

For the fourth exemplary embodiment, the method comprises the following steps with reference to FIGS. 11-13:

a) assemble a subsea module on supports or directly on the service deck of a vessel, fixing the subsea module to the vessel by a cable;

b) transport of the subsea module to the location for installation on the seabed;

c) link the subsea module to a second cable of a second vessel;

d) withdraw the subsea module from the service deck, keeping the module at water level by means of the cables of the two vessels;

e) release the cable to allow the subsea module to come to a vertical position within the water; and f) descend the subsea by releasing the cable, in the vertical position, into the sea.

For the sixth exemplary embodiment, the method comprises the following steps, with reference to FIGS. 14-16:

a) assemble a subsea module to a plurality of floats on the service deck of the vessel, fixing the subsea module to the vessel by a cable;

b) link the subsea module to a second cable from a second vessel;

c) withdraw the subsea module together with the floats from the service deck, maintaining the module linked by means of the two cables of the two vessels;

d) release the cable and retrieving the subsea module from the floats to allow the module to come to a vertical position; and e) descend the subsea module by releasing the cable, in the vertical position into the sea.

For the seventh exemplary embodiment, the method comprises the following with reference to FIGS. 17-23:

a) bring a vessel with a cable next to a production vessel (13) with a structure (14), similar to a balcony, in which a subsea module is placed;

b) link the cable to the subsea module in a vertical position;

c) take the subsea module down to the sea level;

d) release the subsea module from the production vessel; from the ship and e) descend the subsea module by releasing the cable, in the vertical position into the sea.

For the eighth exemplary embodiment, the method comprises the following steps with reference to FIGS. 24-25:

a) assemble the subsea module to one side of a vessel with a crane and a cable;

b) link one end of the subsea module to the motor module of a rotating support and the other end to the cable;

c) rotate the arm of the motor module while controlling the release of the cable in such a way as to bring the subsea module into a vertical position; and d) descend the subsea module by releasing the cable, in the vertical position, into the sea.

Further, two methods are described with the use of a counterbalancing device (17), which serves to reduce the movement transferred from the sea surface waves to the subsea module (2) when it is being installed or replaced. The counterbalancing device which references to FIGS. 26, 27 and 28 can be used with any of the exemplary embodiments so far expressed, but FIGS. 29 and 30 show the application to with the second exemplary embodiment. The method steps refer to installation of a subsea module (2), but the retrieval follows the same steps in the reverse order.

A first method for a situation in which the counterbalancing device is located on the seabed comprises the following steps:

a) assemble the subsea module (2) to the service deck of a vessel (1);

b) transport of the subsea module (2) to the installation location at sea;

c) launch into the sea of a remote controlled vehicle (R) carrying a traction cable (K), (see FIG. 26);

d) connect the traction cable (K) to the top of the signaling buoy (172) of the counterbalancing device (17) by use of the remote controlled vehicle (R);

e) recover the counterbalancing device (17) close to the surface;

f) connect the cable (K2) to the subsea module;

g) descend the subsea by cable (K3) to a depth close to that of the lined borehole (F);

h) fit the extremity of the subsea module (2) into the interior of the lined borehole (F) and the descent is continued until the total coupling of the latter;

i) disconnected the traction cable (K2) from the top of the buoy (172) of the counterbalancing device (17) (FIG. 27) using the remote-controlled vehicle (R).

A second possibility in which the counterbalancing device (17) is on the transport vessel (1) comprises:

a) assemble the subsea module (2) to the service deck of a vessel (1);

b) transport of the subsea module (2) and the counterbalancing device (17) to the location of the installation at sea;

c) the order of stages of the launch operation can be chosen between:

(i) launch the counterbalancing device (17) into the sea, positioning it close to the vessel on the surface of the sea connected to the traction cable (K), (FIG. 29);

(ii) connect the cable (K2) of the counterbalancing device (17) to the subsea module (2);

(iii) launch the subsea module (2) into the sea (FIG. 30);

(iv) launch the counterbalancing device (17) connected to the traction cable (iv) into the sea (FIG. 29);

(v) connect the sustaining cable (K2) of the counterbalancing device (17) to the subsea module (2);

d) lower the counterbalancing device (17) and the subsea module (2) to the seabed until the latter is totally coupled in the interior of the lined borehole (F), (FIG. 28); and e) disconnect the traction cable (K) from the counterbalancing device that is temporarily parked at the side of the lined borehole (F), (FIG. 27).

The description of the systems for installation and replacement of subsea modules, and also of the methods applied thereby, should be considered only as example embodiments of the invention. They do not limit the invention, which is limited only to the scope of the set of claims.

The invention claimed is:

1. A system for underwater installation and replacement of a subsea module of great length, comprising:

a vessel for installation of the subsea module on the seabed, a production vessel for assembling or disassembling the subsea module on a deck of the production vessel while at sea, and for helping in a transfer operation of the vessel for installation, a structure for assembling or disassembling the subsea module rigidly mounted on a side of the production vessel, and the vessel for installation including at least one cable for descending or retrieving the subsea module hung in a vertical position into the sea to the seabed, wherein the subsea module is a thin tube of dozens of meters length to be installed or replaced without the need of an offshore rig or drill pipes.

2. The system according to claim 1, further comprising a crane provided on the production vessel that brings the subsea module to the vertical position.

3. The system according to claim 1, wherein the production vessel includes a second cable for withdrawing the subsea module from the production vessel and descending the module to the vertical position.

4. The system according to claim 1, wherein structure for assembling or disassembling the subsea module comprises a structure having an empty cube shape with a horizontal floor to allow manipulating and fixing of the subsea module.

5. A method for installation and replacement using the system defined in claim 2, comprising the following steps:

a) assembling the subsea module on supports or directly on the service deck of the vessel, fixing the subsea module to the vessel by the cable;

b) transporting the subsea module to the location for installation on the seabed, where there is the floating structure with the crane;

c) coupling the crane to the subsea module to raise the subsea module from the service deck;

d) hanging the subsea module in the vertical position using the crane; and e) descending the subsea module, by releasing the cable, in the vertical position into the sea.

6. A method for installation and replacement using the system defined in claim 3, comprising the following steps:

a) assembling the subsea module on supports or directly on the service deck of the vessel, fixing the subsea module to the vessel by the cable;

b) transporting the subsea module to the location for installation on the seabed;

c) linking the subsea module to the second cable of a second vessel;

d) withdrawing the subsea module from the service deck, keeping the module at water level by the cables of the two vessels;

e) releasing the cable to allow the subsea module to come to the vertical position within the water; and f) descending the subsea by releasing the cable, in the vertical position, into the sea.

7. A method for installation and replacement using the system defined in claim 4, comprising the following steps:

a) bringing the vessel with the cable next to the production vessel, in which the subsea module is placed;

b) linking the cable to the subsea module in the vertical position;

c) taking the subsea module down to the sea level;

d) releasing the subsea module from the production vessel; and e) descending the subsea module by releasing the cable, in the vertical position into the sea.

* * * * *